US007323020B2

(12) United States Patent
Hull et al.

(10) Patent No.: US 7,323,020 B2
(45) Date of Patent: Jan. 29, 2008

(54) METHOD FOR MAKING A FUEL FOR A MODIFIED SPARK IGNITION COMBUSTION ENGINE, A FUEL FOR A MODIFIED SPARK IGNITION COMBUSTION ENGINE AND A FUEL ADDITIVE FOR A CONVENTIONAL SPARK IGNITION COMBUSTION ENGINE

(76) Inventors: Angelica Hull, Fjällvägen 3B, Lidingö18131 (SE); Igor Golubkov, Fjällvägen 3B, Lidingö 18131 (SE)

( * ) Notice: Subject to any disclaimer, the term of this patent is extended or adjusted under 35 U.S.C. 154(b) by 583 days.

(21) Appl. No.: 10/734,215

(22) Filed: Dec. 15, 2003

(65) Prior Publication Data

US 2004/0123516 A1 Jul. 1, 2004

Related U.S. Application Data

(60) Division of application No. 10/237,174, filed on Sep. 9, 2002, now Pat. No. 6,761,745, which is a continuation-in-part of application No. 09/767,940, filed on Jan. 24, 2001, now abandoned, and a continuation-in-part of application No. 09/612,572, filed on Jul. 7, 2000, now abandoned.

(30) Foreign Application Priority Data

Jan. 24, 2000 (WO) ..... PCT/SE00/00139

(51) Int. Cl.
*C10L 1/18* (2006.01)

(52) U.S. Cl. ..... 44/451; 44/350; 44/388; 44/448; 44/437; 44/439; 44/349

(58) Field of Classification Search ..... 44/451, 44/350, 388, 448, 437, 438, 439, 349
See application file for complete search history.

(56) References Cited

U.S. PATENT DOCUMENTS

| | | | | |
|---|---|---|---|---|
| 2,104,021 | A | 1/1938 | Callis | 44/9 |
| 2,365,009 | A | 12/1944 | Robertson | 44/43 |
| 3,082,070 | A | 3/1963 | Eckert | 44/385 |
| 4,207,076 | A | 6/1980 | Bove et al. | 44/56 |
| 4,328,004 | A | 5/1982 | Globus | 44/56 |

(Continued)

FOREIGN PATENT DOCUMENTS

| | | |
|---|---|---|
| CN | 1044489 | 8/1990 |

(Continued)

OTHER PUBLICATIONS

Thomas W. Kirchstetter et al., "Impact of California Reformulated Gasoline on Motor Vehicle Emissions. 1. Mass Emission Rates," 33*Environ. Sci. Technol.*318-28 (1999).

(Continued)

*Primary Examiner*—Cephia D. Toomer
(74) *Attorney, Agent, or Firm*—Fitzpatrick, Cella, Harper & Scinto

(57) ABSTRACT

A method of making a fuel composition for a modified internal combustion spark ignition engine comprising combining a fuel grade ethanol, an oxygen-containing component and at least one $C_6$-$C_{12}$ hydrocarbon. A fuel produced by such a method is also provided.

7 Claims, 2 Drawing Sheets

U.S. PATENT DOCUMENTS

| | | | | |
|---|---|---|---|---|
| 4,378,973 | A | 4/1983 | Sweeney | 44/352 |
| 4,398,920 | A | 8/1983 | Guibet et al. | 44/56 |
| 4,444,565 | A | 4/1984 | Croudace | 44/386 |
| 4,451,266 | A | 5/1984 | Barclay et al. | 44/53 |
| 4,468,233 | A | 8/1984 | Bruderreck et al. | 44/56 |
| 4,541,835 | A | 9/1985 | Norton et al. | 44/53 |
| 4,541,836 | A | 9/1985 | Derderian | 44/53 |
| 4,806,129 | A | 2/1989 | Dorn et al. | 44/56 |
| 4,818,250 | A | 4/1989 | Whitworth | 44/62 |
| 5,015,356 | A | 5/1991 | Talbert | 208/16 |
| 5,208,402 | A | 5/1993 | Wilson | 585/1 |
| 5,290,325 | A | 3/1994 | Kanne et al. | 44/400 |
| 5,314,511 | A | 5/1994 | Liotta, Jr. et al. | 44/322 |
| 5,433,756 | A | 7/1995 | Gonzalez | 44/340 |
| 5,607,486 | A | 3/1997 | Wilkins, Jr. | 44/307 |
| 5,688,295 | A | 11/1997 | Yang | 44/320 |
| 5,697,987 | A | 12/1997 | Paul | 44/352 |
| 5,968,211 | A | 10/1999 | Schilowitz | 44/402 |
| 6,039,772 | A | 3/2000 | Orr | 44/359 |
| 6,565,617 | B2 * | 5/2003 | Kalghatgi | 44/451 |
| 6,712,866 | B2 * | 3/2004 | Paul | 44/352 |
| 6,761,745 | B2 * | 7/2004 | Hull et al. | 44/451 |
| 2002/0026744 | A1 | 3/2002 | Golubkov et al. | 44/436 |

FOREIGN PATENT DOCUMENTS

| | | | |
|---|---|---|---|
| EP | 0121089 | A1 | 10/1984 |
| EP | 0171440 | A1 | 2/1986 |
| ES | 2 012 729 | | 4/1990 |
| FR | 2 500 844 | | 9/1982 |
| GB | 2 090 613 | A | 7/1982 |
| GB | 2090612 | A | 7/1982 |
| WO | WO 87/01384 | A1 | 3/1987 |
| WO | WO 94/21753 | | 9/1994 |
| WO | WO 97/43356 | | 11/1997 |
| WO | WO 99/35215 | A2 | 7/1999 |
| WO | WO 00/31216 | A1 | 6/2000 |
| WO | WO 01/53437 | A1 | 7/2001 |

OTHER PUBLICATIONS

Automotive Fuels—Unleaded Petrol—Requirements and Test Methods, BS EN 228:1999 (Dec. 1998).

Automotive Fuels—Unleaded Petrol—Requirements and Test Methods, BS EN 228:2000 (Nov. 1999).

Australian Patent Application No. AU-A 25207/84.

Specification for Automotive Diesel Fuels, BS EN 590: 1997 (1997).

F. Karaosmanoglu et al., "The Effects of Blending Agents on Alcohol-Gasoline Fuels," 66 *J. Inst. Energy* 9-12 (1993).

A. Schmidt, "Use of 95 %-Ethanol in Mixtures With Gasoline," *Energy From Biomass, 1st E.C. Conference*, pp. 928-933 (1980).

D. Zudkevitch et al., "Thermodynamics of Reformulated Automotive Fuels," 74(6) *Hydrocarbon Processing* 93-100 (1995).

Frank W. Cox, "The Physical Properties of gasoline/Alcohol Automotive Fuels," *Proceedings of Third International Symposium on Alcohol Fuels Technology*II-22, pp. 1-14 (1980).

* cited by examiner

METHOD FOR MAKING A FUEL FOR A MODIFIED SPARK IGNITION COMBUSTION ENGINE, A FUEL FOR A MODIFIED SPARK IGNITION COMBUSTION ENGINE AND A FUEL ADDITIVE FOR A CONVENTIONAL SPARK IGNITION COMBUSTION ENGINE

This application is a division of application Ser. No. 10/237,174, filed on Sep. 9, 2002, incorporated by reference herein, which is a continuation-in-part of application Ser. No. 09/612,572, filed on Jul. 7, 2000, and a continuation-in-part of application Ser. No. 09/767,940, filed on Jan. 24, 2001.

BACKGROUND OF THE INVENTION

Field of the Invention

This invention relates to unleaded motor fuel for spark ignition internal combustion engines. More particularly the invention relates to a method for lowering the dry vapor pressure equivalent (DVPE) of a fuel composition including a hydrocarbon liquid and ethanol by using an oxygen-containing compounds and $C_6$-$C_{12}$ hydrocarbons. The ethanol and DVPE adjusting components used to obtain the fuel composition are preferably derived from renewable raw materials. By means of the method of the invention motor fuels containing up to 20% by volume of ethanol meeting standard requirements for spark ignition internal combustion engines operating with gasoline are obtainable.

Conventional gasoline ("gasoline") is the major fuel for spark ignition internal combustion engines. As employed herein, the phrase conventional gasoline includes a volatile, highly inflammable, generally colorless, liquid obtained by fractional distillation of petroleum. The extensive use of gasoline results in the pollution of the environment. The combustion of gasoline derived from crude oil or mineral gas disturbs the carbon dioxide balance in the atmosphere, and causes the greenhouse effect. Crude oil reserves are decreasing steadily with some countries already facing crude oil shortages.

The growing concern for the protection of the environment, tighter requirements governing the content of harmful components in exhaust emissions, and crude oil shortages, force industry to develop urgently alternative fuels which burn more cleanly.

The existing global inventory of vehicles and machinery operating with spark ignition internal combustion engines does not allow currently the complete elimination of gasoline as a motor fuel.

The task of creating alternative fuels for internal combustion engines has existed for a long time and a large number of attempts have been made to use renewable resources for yielding motor fuel components.

U.S. Pat. No. 2,365,009, issued in 1944 describes the combination of $C_1$-$C_5$ alcohols and $C_3$-$C_5$ hydrocarbons for use as a fuel. In U.S. Pat. No. 4,818,250 issued in 1989 it is proposed to use limonene obtained from citrus and other plants as a motor fuel, or as a component in blends with gasoline. In U.S. Pat. No. 5,607,486 issued in 1997, there are disclosed novel engine fuel additives comprising terpenes, aliphatic hydrocarbons and lower alcohols.

Currently tert-butyl ethers are widely used as components of gasolines. Motor fuels comprising tert-butyl ethers are described in U.S. Pat. No. 4,468,233 issued in 1984. The major portion of these ethers is obtained from petroleum refining, but can equally be produced from renewable resources.

Ethanol is a most promising product for use as a motor fuel component in mixtures with gasoline. Ethanol is obtained from the processing of renewable raw material, known generically as biomass, which, in turn, is derived from carbon dioxide under the influence of solar energy.

The combustion of ethanol produces significantly less harmful substances in comparison to the combustion of gasoline. However, the use of a motor fuel principally containing ethanol requires specially designed engines. At the same time spark ignition internal combustion engines normally operating on gasoline can be operated with a motor fuel comprising a mixture of gasoline and not more than about 10% by volume of ethanol. Such a mixture of gasoline and ethanol is presently sold in the United States as gasohol. Current European regulations concerning gasolines allow the addition to gasoline of up to 5% by volume of ethanol.

The major disadvantage of mixtures of ethanol and conventional gasoline is that for mixtures containing up to about 20% by volume of ethanol there is an increase in the dry vapor pressure equivalent as compared to that of the conventional gasoline.

FIG. 1 shows the behavior of the dry vapor pressure equivalent (DVPE) as a function of the ethanol content of mixtures of ethanol and gasoline A92 summer, and gasoline A95 summer and winter at 37.8° C. The gasolines known as A92 and A95 are standard, conventional gasolines purchased at gas stations in the United States and Sweden. Gasoline A92 originated in the United States and gasoline A95, in Sweden. The ethanol employed was fuel grade ethanol produced by Williams, USA. The DVPE of the mixtures was determined according to the standard ASTM D-5191 method at the SGS laboratory in Stockholm, Sweden.

For the range of concentrations by volume of ethanol between 5 and 10% which is of particular interest for use as a motor fuel for standard spark ignition engines, the data in FIG. 1 show that the DVPE of mixtures of gasoline and ethanol can exceed the DVPE of source gasoline by more than 10%. Since the commercial petroleum companies normally supply the market with gasoline already at the maximum allowed DVPE, which is strictly limited by current regulations, the addition of ethanol to such presently commercially available gasolines is not possible.

It is known that the DVPE of mixtures of gasoline and ethanol can be adjusted. U.S. Pat. No. 5,015,356 granted on May 14, 1991 proposes reformulating gasoline by removing both the volatile and non-volatile components from $C_4$-$C_{12}$ gasoline to yield either $C_6$-$C_9$ or $C_6$-$C_{10}$ intermediate gasoline. Such fuels are said to better facilitate the addition of alcohol over current gasoline because of their lower dry vapor pressure equivalent (DVPE). A disadvantage of this method of adjusting the DVPE of mixtures of gasoline and ethanol is that in order to obtain such a mixture it is necessary to produce a special reformulated gasoline, which adversely affects the supply chain and results in increased prices for the motor fuel. Also, such gasolines and their mixtures with ethanol have a higher flash point, which impairs their performance properties.

It is known that some chemical components decrease DVPE when added to gasoline or to a mixture thereof with ethanol. For example, U.S. Pat. No. 5,433,756 granted on Jul. 18, 1995 discloses chemical clean-combustion-promoter compounds comprising, in addition to gasoline, ketones, nitro-paraffin and also alcohols other than ethanol. It is noted that the composition of the catalytic clean-combustion-promoter disclosed in the patent reduces the DVPE of gasoline fuel. Nothing is mentioned in this patent about the impact of the clean-combustion-promoter composition on the DVPE of mixtures of gasoline and ethanol.

U.S. Pat. No. 5,688,295 granted on Nov. 18, 1997 provides a chemical compound as an additive to gasoline or as a fuel for standard gasoline engines. In accordance with the invention, an alcohol-based fuel additive is proposed. The fuel additive comprises from 20-70% alcohol, from 2.5-20% ketone and ether, from 0.03-20% aliphatic and silicon compounds, from 5-20% toluene and from 4-45% mineral spirits. The alcohol is methanol or ethanol. It is noted in the patent that the additive improves gasoline quality and specifically decreases DVPE. The disadvantages of this method of motor fuel DVPE adjustment are that there is a need for large quantities of the additive, namely, not less than 15% by volume of the mixture; and the use of silicon compounds, which form silicon oxide upon combustion, results in increased engine wear.

In WO9743356 a method for lowering the vapor pressure of a hydrocarbon-alcohol blend by adding a co-solvent for the hydrocarbon and alcohol to the blend, is described. A spark ignition motor fuel composition is also disclosed, including a hydrocarbon component of $C_5$-$C_8$ straight-chained or branched alkanes, essentially free of olefins, aromatics, benzene and sulphur, in which the hydrocarbon component has a minimum anti-knock index of 65, according to ASTM D-2699 and D-2700 and a maximum DVPE of 15 psi, according to ASTM D-5191; a fuel grade alcohol; and a co-solvent for the hydrocarbon component and alcohol in which the components of the fuel composition are present in amounts selected to provide a motor fuel with a minimum anti-knock index of 87 and a maximum DVPE of 15 psi. The co-solvent used is biomass-derived 2-methyltetrahydrofuran (MTHF) and other heterocyclic ethers such as pyrans and oxepans, MTHF being preferred.

The disadvantages of this method for adjusting the dry vapor pressure equivalent of mixtures of hydrocarbon liquid and ethanol are the following:

(1) It is necessary to use only hydrocarbon components $C_5$-$C_8$ which are straight-chained or branched alkanes (i) free of such unsaturated compounds as olefins, benzene and other aromatics, (ii) free of sulphur and, as follows from the description of the invention, (iii) the hydrocarbon component is a coal gas condensate or natural gas condensate;

(2) It is necessary to use as a co-solvent for the hydrocarbon component and ethanol only one particular class of chemical compounds containing oxygen; namely, ethers, including short-chained and heterocyclic ethers;

(3) It is necessary to use a large quantity of ethanol in the fuel, not less than 25%;

(4) It is necessary to use a large quantity of co-solvent, not less than 20%, of 2-methyltetrahydrofuran; and (5) It is required to modify the spark ignition internal combustion engine when operating with such fuel composition and, specifically, one must change the software of the on-board computer or replace the on-board computer itself.

The article by D. Zudkevitch et. al. entitled "Thermodynamics of Reformulated Automotive Fuels" (Hydrocarbon Processing, vol. 76, no. 6, 1995) discloses compositions of the ethanol-containing gasolines, which also contain tert-butyl alcohol ethers. The presence of the latter results in a reduction of the vapor pressure, compared to the vapor pressure of the ethanol-containing gasoline. However, the vapor pressure of the three-component mixture is higher than the vapor pressure of the gasoline, which is one of the components of the mixture. Therefore, to achieve the vapor pressure of standard gasolines, these gasolines should be reformulated.

The reduction in the vapor pressure of a three-component mixture can also be achieved by adding to the fuel composition considerable amounts of the oxygen-containing compounds. However, the increased oxygen content in the fuel would worsen performance of a standard spark ignition combustion engine due to a decrease in the heat of combustion of such fuel.

Accordingly, one of the objects of the present invention is to provide a method by which the above-mentioned drawbacks of the prior art can be overcome. It is a primary object of the invention to provide a method of reducing the vapor pressure of a $C_3$ to $C_{12}$ hydrocarbon based fuel mixture containing up to 20% by volume of ethanol for conventional gasoline engines so that it is not more than the vapor pressure of the $C_3$ to $C_{12}$ hydrocarbon itself, or at least so that it meets the standard requirements for gasoline fuel.

SUMMARY OF THE INVENTION

The above-mentioned objects of the present invention have been accomplished by means of the method comprising combining:

(a) a hydrocarbon component comprising $C_3$ to $C_{12}$ hydrocarbon fractions;

(b) an ethanol component comprising fuel grade ethanol, said ethanol component comprising 0.1% to 20% of the composition by volume;

(c) an oxygen-containing component comprising at least one of (1) an alkanol having from 3 to 10 carbon atoms; (2) a ketone having from 4 to 9 carbon atoms; (3) a dialkyl ether having from 6 to 10 carbon atoms; (4) an alkyl ester of an alkanoic acid, said alkyl ester having 5 to 8 carbon atoms; (5) a hydroxyketone having 4 to 6 carbon atoms; (6) a keto ester of an alkanoic acid, said keto ester having 5 to 8 carbon atoms or (7) an oxygen-containing heterocyclic compound having 5 to 8 carbon atoms selected from the group consisting of tetrahydrofurfuryl alcohol, tetrahydrofurfuryl acetate, dimethyltetrahydrofuran, tetramethyltetrahydrofuran, methyl tetrahydropyran, 4-methyl-4-oxytetrahydropyran, and mixtures thereof, and said oxygen-containing additive comprises 0.05% to 15% of the total volume of the motor fuel composition; and (d) at least one $C_6$-$C_2$ hydrocarbon, This fuel composition comprises not more than 0.25% by weight of water according to ASTM D 6304 and not more than 7% by weight of oxygen according to ASTM D 4815. A ratio between components (b)/{(c)+(d)} is from 1:200 to 200:1 by volume.

The present inventors have found that specific types of compounds having an oxygen-containing group surprisingly lower the vapor pressure of a gasoline-ethanol mixture.

They have also found that the octane number of the resulting hydrocarbon based fuel mixture can surprisingly be maintained or even increased by using the oxygen-component of the present invention in combination with $C_6$-$C_{12}$ hydrocarbons.

According to the present method, up to about 20% by volume of fuel grade ethanol (b) can be used in the overall fuel compositions. The oxygen-containing compounds (c) used can be obtained from renewable raw materials, and the hydrocarbon component (a) used can for example be any standard gasoline (which does not have to be reformulated)

and can optionally contain aromatic fractions and sulphur, and also hydrocarbons obtained from renewable raw materials.

By means of the method of the invention fuels for standard spark ignition internal combustion engines can be prepared, which fuels allow such engines to have the same maximum performance as when operated on standard gasoline currently on the market. A decrease in the level of toxic emissions in the exhaust and a decrease in the fuel consumption can also be obtained by using the method of the invention.

According to one aspect of the invention, in addition to the dry vapor pressure equivalent (DVPE), the anti-knock index (octane number) can also be desirably controlled. The octane number can be at least the same as that of the hydrocarbon component (a) or meet mandatory regulation limits for octane numbers without employing organo-metallic anti-knock additives.

It is yet another object to provide an additive mixture of fuel grade ethanol (b) and oxygen-containing additive (c) and an additional component (d), in which component (d) comprises at least one $C_6$-$C_{12}$ hydrocarbon and is present in an amount up to 99% by volume. This mixture can then be subsequently used in the method of the present invention, i.e., added to the hydrocarbon component (a).

The mixture of (b), (c) and (d) can also be used per se as a fuel for modified engines, i.e., not standard-type gasoline engines. The additive mixture can also be used for adjusting the octane number and/or for lowering the vapor pressure of a high vapor pressure hydrocarbon component.

Further objects and advantages of the present invention will be evident from the following detailed description, examples and dependent claims.

DETAILED DESCRIPTION OF THE PRESENT INVENTION

The present method enables the use of $C_3$-$C_{12}$ hydrocarbon fractions as hydrocarbon component (a), including narrower ranges within this broader range, without restriction on the presence of saturated and unsaturated hydrocarbons, aromatics and sulphur. In particular, the hydrocarbon component can be a standard gasoline currently on the market, as well as other mixtures of hydrocarbons obtained in the refining of petroleum, off-gas of chemical-recovery coal carbonization, natural gas and synthesis gas. Hydrocarbons obtained from renewable raw materials can also be included. The $C_3$-$C_{12}$ fractions are usually prepared by fractional distillation or by blending various hydrocarbons.

Importantly, and as previously mentioned, the component (a) can contain aromatics and sulphur, which are either co-produced or naturally found in the hydrocarbon component.

According to the method of the present invention the DVPE can be reduced for fuel mixtures containing up to 20% by volume of ethanol, calculated as pure ethanol. According to a preferred embodiment, the vapor pressure of the hydrocarbon based ethanol-containing fuel mixture is reduced to a vapor pressure corresponding to that of the hydrocarbon component alone, and/or to the vapor pressure according to any standard requirement on commercially sold gasoline.

As will be evident from the examples, the DVPE can, if desired, be reduced to an even lower level than that of the hydrocarbon component used.

Figure 1:
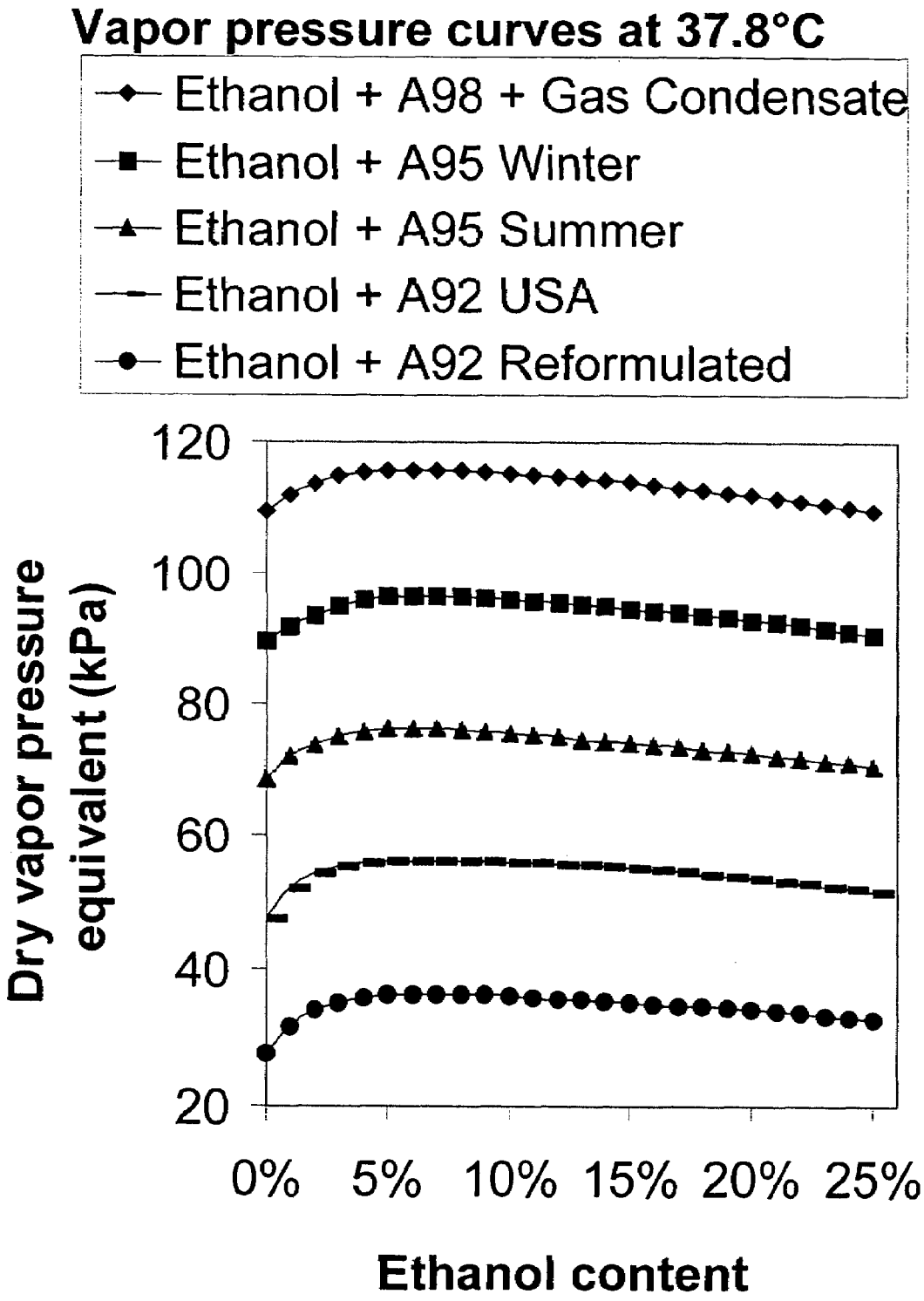
In FIG. 1, the behavior of the dry vapor pressure equivalent (DVPE) as a function of the ethanol content of prior art mixtures of ethanol and gasoline is shown.

It should be noted that simply adding $C_6$-$C_{12}$ hydrocarbon compounds to gasoline-ethanol mixtures does not alleviate the vapor pressure increase of the mixtures when the ethanol content of the fuel composition is from 0 to 20% by volume. FIG. 1 shows the relationship between the DVPE and the change in the ethanol content of the mixture with a $C_3$ to $C_{12}$ hydrocarbon component and $C_6$-$C_{12}$ hydrocarbon compounds. This relationship shows that adding ethanol to such hydrocarbon compositions results in a more significant increase of the vapor pressure than adding ethanol to lighter hydrocarbon fractions.

According to the most preferred embodiment, the other properties of the fuel, such as for example the octane number, are kept within the required regulatory limits. In particular, the motor fuel compositions of the present invention do not require the addition of organo-metallic anti-knock additives to achieve such anti-knock performance.

This is accomplished by combining:

(a) a hydrocarbon component comprising $C_3$ to $C_{12}$ hydrocarbon fractions;

(b) an ethanol component comprising fuel grade ethanol for conventional spark ignition internal combustion engines;

(c) at least one oxygen-containing compound; and (d) at least one $C_6$-$C_{12}$ hydrocarbon.

The motor fuel composition of the present invention can be prepared by first adding the oxygen-containing component (c) and component (d) to the ethanol component (b) and subsequently adding the mixture of (c), (b) and (d) to the hydrocarbon component (a). The motor fuel composition of the present invention can also be prepared by adding the ethanol component (b) to the hydrocarbon component (a) and then adding the oxygen-containing component (c) and component (d) to the mixture of (b) and (a).

The oxygen-containing organic compound and the $C_6$-$C_{12}$ hydrocarbon enable the adjustment of (i) the dry vapor pressure equivalent, (ii) the anti-knock index and other performance parameters of the motor fuel composition as well as (iii) the reduction of the fuel consumption and the reduction of toxic substances in the engine exhaust emissions. The oxygen-containing compound (c) has bound oxygen in at least any one of the following functional groups:

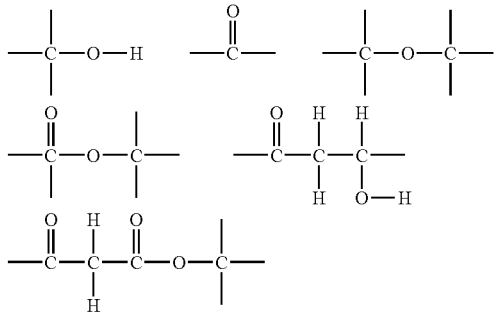

-continued

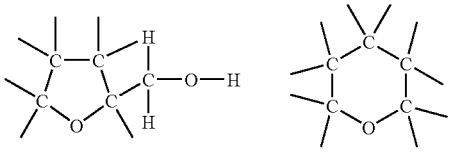

Such functional groups are present, for example, in the following classes of organic compounds and which can be used in the present invention:alcohols, ketones, ethers, esters, hydroxyketones, ketone esters, and with oxygen-containing heterocyclic rings.

The fuel additive can be derived from fossil-based sources or preferably from renewable sources such as biomass.

The oxygen-containing fuel additive (c) can typically be an alcohol, other than ethanol. In general, aliphatic or alicyclic alcohols, both saturated and unsaturated, preferably alkanols, are employed. More preferably, alkanols of the general formula: R—OH where R is an alkyl group with 3 to 10 carbon atoms, most preferably 3 to 8 carbon atoms, such as propanol, isopropanol, n-butanol, isobutanol, tert-butanol, n-pentanol, isopentanol, tert-pentanol, 4-methyl-2-pentanol, diethylcarbinol, diisopropylcarbinol, 2-ethylhexanol, 2,4,4-trimethylpentanol, 2,6-dimethyl-4-heptanol, linalool, 3,6-dimethyl-3-octanol, phenol, phenylmethanol, methylphenol, methylcyclohexanol or similar alcohols, are employed, as well as their mixtures.

The component (c) can also be an aliphatic or alicyclic ketone, both saturated and unsaturated, of the general formula

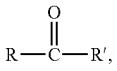

where R and R' are the same or different and are each $C_1$-$C_6$ hydrocarbons, which also can be cyclic, and are preferably $C_1$-$C_4$ hydrocarbons. Preferred ketones have a total (R+R') of 4 to 9 carbon atoms and include methylethyl ketone, methylpropyl ketone, diethylketone, methylisobutyl ketone, 3-heptanone, 2-octanone, diisobutyl ketone, cyclohexanone, acetofenone, trimethylcyclohexanone, or similar ketones, and mixtures thereof.

The component (c) can also be an aliphatic or alicyclic ether, including both saturated and unsaturated ethers, of the general formula R—O—R', wherein R and R' are the same or different and are each a $C_1$-$C_{10}$ hydrocarbon group. In general, lower ($C_1$-$C_6$) dialkyl ethers are preferred. The total number of carbon atoms in the ether is preferably from 6 to 10. Typical ethers include methyl-tert-amyl ether, methylisoamyl ether, ethylisobutyl ether, ethyl-tert-butyl ether, dibutyl ether, diisobutyl ether, diisoamyl ether, anisole, methylanisole, phenetole or similar ethers and mixtures thereof.

The component (c) may further be an aliphatic or alicyclic ester, including saturated and unsaturated esters, of the general formula

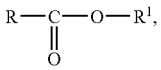

where R and R' are the same or different. R and R' are preferably hydrocarbon groups, more preferably alkyl groups and most preferably alkyl and phenyl having 1 to 6 carbon atoms. Especially preferred is an ester where R is $C_1$-$C_4$ and R' is $C_4$-$C_6$. Typical esters are alkyl esters of alkanoic acids, including n-butylacetate, isobutylacetate, tert-butylacetate, isobutylpropionate, isobutylisobutyrate, n-amylacetate, isoamylacetate, isoamylpropionate, methylbenzoate, phenylacetate, cyclohexylacetate, or similar esters and mixtures thereof. In general, it is preferred to employ an ester having from 5 to 8 carbon atoms.

The additive (c) can simultaneously contain two oxygen-containing groups connected in the same molecule with different carbon atoms.

The additive (c) can be a hydroxyketone. A preferred hydroxyketone has the general formula:

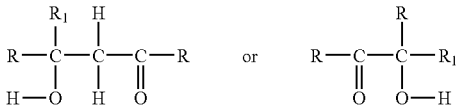

wherein R is an alkyl group, and $R_1$ is hydrogen or an alkyl group, preferably a lower alkyl group, i.e. ($C_1$-$C_4$). In general, it is preferred to employ a ketol having 4 to 6 carbon atoms. Typical hydroxyketones include 1-hydroxy-2-butanone, 3-hydroxy-2-butanone, 4-hydroxy-4-methyl-2-pentanone, or similar ketols or mixture thereof.

In yet another embodiment the fuel additive (c) is a ketone ester, preferably of the general formula:

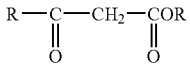

where R is an alkyl group, preferably a lower alkyl group, i.e. ($C_1$-$C_4$).

Typical ketone esters include methylacetoacetate, ethyl acetoacetate and tert-butyl acetoacetate. Preferably, such ketone esters have 6 to 8 carbon atoms, and, more preferably, 5 to 8 carbon atoms.

The additive (c) can also be a ring-oxygen-containing heterocyclic compound and, preferably, the oxygen-containing heterocycle has a $C_4$-$C_5$ ring. More preferably, the heterocycle additive has a total of 5 to 8 carbon atoms. The additive can preferably have the formula (1) or (2) as follows:

1

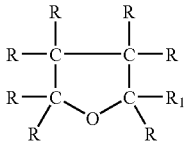

2

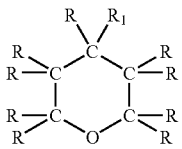

wherein R is hydrogen or an alkyl group, preferably —$CH_3$, and $R_1$ is —$CH_3$, or —OH, or —$CH_2OH$, or $CH_3CO_2CH_2$—.

A typical heterocyclic additive (c) is tetrahydrofurfuryl alcohol, tetrahydrofurfuryl acetate, dimethyltetrahydrofuran, tetramethyltetrahydrofuran, methyltetrahydropyran, 4-methyl-4-oxytetrahydropyran or similar heterocyclic additives, or mixtures thereof.

Component (c) can also be a mixture of any of the compounds set out above from one or more of the above-mentioned different compound classes.

Suitable fuel grade ethanol (b) to be used according to the present invention can readily be identified by the person skilled in the art. A suitable example of the ethanol component is an ethanol component comprising at least about 99.5% ethanol by volume. Any impurities included in the ethanol in an amount of at least 0.5% by volume thereof and falling within the above-mentioned definition of component (c) or (d) should be taken into account when determining the amount of the corresponding component used. That is, such impurities must be included in an amount of at least 0.5% in the ethanol component in order to be taken into account as a part of component (c) or (d). Any water, if present in the ethanol component, should preferably amount to no more than about 0.25% by weight of the total fuel mixture, in order to meet the current regulatory requirements for gasoline engine fuels.

Thus, a denatured ethanol mixture as supplied to the market, containing about 92% of ethanol, hydrocarbons and by-products, can also be used as the ethanol component in the fuel composition according to the invention.

Unless otherwise indicated, all amounts are in % by volume based on the total volume of the motor fuel composition.

Generally, the ethanol component (b) is employed in amounts from 0.1% to 20%, typically from about 1% to 20% by volume, preferably 3% to 15% by volume and more preferably from about 5 to 10% by volume. The oxygen-containing compound (c) is generally employed in amounts from 0.05% to about 15% by volume, more generally from 0.1 to about 15% by volume, preferably from about 3 to about 10% by volume and most preferably from about 5 to about 10% by volume.

In general, the total volume of ethanol component (b) and oxygen-containing component (c) is from 0.15 to 25% by volume, normally from about 0.5 to 25% by volume, preferably from about 1 to 20% by volume, more preferably from 3 to 15% by volume, and most preferably from 5 to 15% by volume.

The total oxygen content of the motor fuel composition based on the ethanol and the oxygen-containing compounds, expressed in terms of weight % oxygen based on total weight of motor fuel composition, is preferably no greater than about 7 wt. %, more preferably no greater than about 5 wt. %.

The amount of 7% by weight of the bound oxygen in chemical compounds is the maximum content of oxygen for the gasoline-ethanol fuels ((a)+(b)), which also comprise at least one oxygen-containing compound (c) other than ethanol (b) and at least one hydrocarbon component (d), resulting in a normal performance of the standard spark ignition engines without any modifications or adjustments.

It should, however, be noted that the oxygen-containing compounds contain bound oxygen, which, normally, does not participate in the process of the hydrocarbons combustion and is a "drag" for the fuel. Such bound oxygen worsens efficiency of the internal combustion engines, resulting in additional costs related to the transportation of the fuel. Therefore, it is preferred to use the gasoline-ethanol fuels ((a)+(b)) comprising, additionally, other oxygen-containing compounds (c) and $C_6$-$C_{12}$ hydrocarbons (d), so that the content of the bound oxygen in the mixture is not more than 5% by weight.

It should be noted that many countries have strict requirements regarding the oxygen content of fuels. Specifically, these countries require that such content be not more than 2.7% by weight of the total weight of the mixture. These restrictions make it more difficult to use oxygen-containing compounds for adjusting the motor fuel properties, and tend to discourage the use of such compounds to reduce the vapor pressure of gasolines. However, as mentioned above, the present invention results in production of a fuel for standard spark ignition internal combustion engines that meets regulatory requirements.

An individual hydrocarbon selected from a $C_6$-$C_{12}$ fraction of aliphatic or alicyclic saturated and unsaturated hydrocarbons can be used as component (d). Preferably, the hydrocarbon component (d) is selected from a $C_8$-$C_{11}$ fraction. Suitable examples of component (d) are benzene, toluene, xylene, ethylbenzene, isopropylbenzene, isopropyltoluene, diethylbenzene, isopropylxylene, tert-butylbenzene, tert-butyltoluene, tert-butylxylene, cyclooctadiene, cyclooctotetraene, limonene, isooctane, isononane, isodecane, isooctene, myrcene, allocymene, tert-butylcyclohexane or similar hydrocarbons and mixtures hereof. Hydrocarbon component (d) can also be a fraction boiling at 100-200° C., obtained in the distillation of oil, bituminous coal resin, or synthesis gas processing products. The amount of component (d) should be selected in such a way, that the ratio of ethanol component (b) to the sum of the components {(c)+(d)} is from 1:200 to 200:1.

According to a preferred embodiment of the invention, to obtain a motor fuel suitable for the operation of a standard spark ignition internal combustion engine the aforesaid hydrocarbon component (a), ethanol component (b), additional oxygen-containing component (c) and additional hydrocarbon component (d) are admixed to obtain the following properties of the resulting motor fuel composition:

density at 15° C. and at normal atmospheric pressure of not less than 690 kg/$m^3$;

oxygen content, based on the amount of oxygen-containing components, of not more than 7% w/w of the motor fuel composition;

anti-knock index (octane number) of not lower than the anti-knock index (octane number) of the source hydrocarbon component and preferably for 0.5(RON+MON) of not less than 80;

dry vapor pressure equivalent (DVPE) essentially the same as the DVPE of the source hydrocarbon component and preferably from 20 kPa to 120 kPa;

acid content of not more than 0.1% by weight HAc;

pH from 5 to 9;

aromatic hydrocarbons content of not more than 40% by volume, including benzene, and for benzene alone, not more than 1% by volume;

limits of evaporation of the liquid at normal atmospheric pressure in percent of source volume of the motor fuel composition:

| | |
|---|---|
| initial boiling point, min | 20° C.; |
| volume (at 70° C., min) of the liquid evaporated | 25% by volume; |

-continued

| | |
|---|---|
| volume (at 100° C., min) of the liquid evaporated | 50% by volume; |
| volume (at 150° C., min) of the liquid evaporated | 75% by volume; |
| volume (at 190° C., min) of the liquid evaporated | 95% by volume; |
| residue of distillation, max. | 2% by volume; |
| final boiling point, max. | 205° C.; |
| sulfur content of not more than | 50 mg/kg; |
| resins content of not more than | 2 mg/100 ml. |

Specifically, a preferred motor fuel composition of the present invention has the following characteristics:

(i) a density at 15° C., according to ASTM D 4052 of at least 690 kg/m$^3$;

(ii) a dry vapor pressure equivalent according to ASTM D 5191 from 20 kPa to 120 kPa;

(iii) an acid content according to ASTM D 1613 of no greater than 0.1 weight % HAc;

(iv) a pH according to ASTM D 1287 from 5 to 9;

(v) an aromatics content according to SS 155120 of no greater than 40% by volume, wherein benzene is present in amounts according to EN 238 no greater than 1% by volume;

(vi) a sulphur content according to ASTM D 5453 of no greater than 50 mg/kg;

(vii) a gum content according to ASTM D 381 of no greater than 2 mg/100 ml;

(viii) distillation properties according to ASTM D86, wherein initial boiling point is at least 20° C.;

a vaporizable portion at 70° C. is at least 25% by volume;

a vaporizable portion at 100° C. is at least 50% by volume;

a vaporizable portion at 150° C. is at least 75% by volume;

a vaporizable portion at 190° C. is at least 95% by volume;

a final boiling point no greater than 205° C.; and an evaporation residue no greater than 2% by volume; and (ix) an anti-knock index 0.5 (RON+MON) according to ASTM D 2699-86 and ASTM D 2700-86 of at least 80.

According to a preferred embodiment of the method of the invention, the ethanol component (b) is first added to the hydrocarbon component (a) and then the oxygen-containing additive (c) and additional hydrocarbon component (d) are added to a mixture of (b) and (a). Afterwards, the resulting motor fuel composition should preferably be maintained at a temperature not lower than −35° C., for at least about one hour. It is a feature of this invention that the components of the motor fuel composition can be merely added to each other to form the desired composition. It is generally not required to agitate or otherwise provide any significant mixing to form the composition.

According to a preferred embodiment of the invention, to obtain a motor fuel composition suitable for operating a standard spark ignition internal combustion engine and with a minimal harmful impact on environment, it is preferable to use oxygen-containing component(s) originating from renewable raw material(s).

As already mentioned, the invention further relates to an additive mixture consisting of components (b), (c) and (d), which subsequently can be added to the hydrocarbon component (a) to be used as a fuel for a modified spark ignition combustion engine.

The additive mixture of components (b) and (c) and (d) can be used as a fuel for a modified spark ignition combustion engine without the addition of the hydrocarbon component (a) or conventional gasoline fuel.

However, to prepare a fuel for use in a conventional gasoline engine, the additive mixture of components (b) and (c) and component (d) should be combined with a conventional gasoline fuel. Sufficient amounts of the additive mixture and the conventional gasoline fuel necessary to provide a vapor pressure of the combination that is not greater than the vapor pressure of the conventional gasoline fuel will be readily apparent to a person skilled in the art.

According to a preferred embodiment, the mixture of components (b), (c) and (d), which can be used in combination with component (a) or by itself in modified engines comprises the oxygen-containing component (c) in an amount from 0.5 to 99%, suitably from 0.5% up to 90%, preferably from 2.5 up to 77.5%, and more preferably from 5 up to 70% by volume; ethanol component (b) in an amount from 0.5-99%, suitably from 9.5 up to 99%, preferably from 20 up to 95%, and more preferably from 25 up to 90% by volume; and hydrocarbon component (d) comprising at least one $C_6$-$C_{12}$ hydrocarbon, more preferably $C_8$-$C_{11}$ hydrocarbon, in an amount providing a ratio of ethanol component (b) to the sum of the other additive components (c)+(d) from 1:200 to 200:1 by volume, more preferable a ratio of ethanol (b) to the sum of the components (c)+(d) is from 1:10 to 10:1 by volume.

The octane number of the additive mixture can be established, and the mixture be used to adjust the octane number of the component (a) to a desired level by admixing a corresponding portion of the mixture of (b), (c) and (d) to component (a).

As examples demonstrating the efficiency of the present invention, the following motor fuel compositions are presented, which are not to be construed as limiting the scope of the invention, but as merely providing illustrations of some of the presently preferred embodiments of this invention.

As will be obvious to the person skilled in the art, all the fuel compositions of the following Examples can of course also be obtained by first preparing a mixture of components (b), (c) and (d), and then this additive mixture can be added to the hydrocarbon component (a), or vice versa. In this case, a certain amount of mixing may be required.

EXAMPLES

To prepare the blended motor fuel the following was used as the components (b), (c), and (d):

(i) fuel grade ethanol purchased in Sweden at SEKAB and in the USA from ADM Corp. and Williams;

(ii) oxygen-containing compounds, individual unsubstituted hydrocarbons and mixtures thereof purchased in Germany from Merck and in Russia from LUKOIL.

(iii) Naphtha, which is an oil straight run gasoline containing aliphatic and alicyclic saturated and unsaturated hydrocarbons. Alkylate, which is a hydrocarbon fraction consisting almost completely of isoparaffine hydrocarbons obtained in alkylation of isobutene by butanol. Alkylbenzene, which is a mixture of aromatic hydrocarbons obtained in benzene alkylation. Mostly, technical grade alkylbenzene comprises ethylbenzene, propylbenzene, isopropylbenzene, butylbenzene and others.

All the testing of source gasolines and ethanol-containing motor fuels, including those comprising the components of this invention was performed employing the standard ASTM methods at the laboratory of SGS in Sweden and at Auto Research Laboratories, Inc., USA.

The drivability testing was performed on a 1987 VOLVO 240 DL according to the standard test method EU2000 NEDC EC 98/69.

The European 2000 (EU 2000) New European Driving Cycle (NEDC) standard test descriptions are identical to the standard EU/ECE Test Description and Driving Cycle (91/441 EEC resp. ECE-R 83/01 and 93/116 EEC). These standardized EU tests include city driving cycles and suburban driving cycles and require that specific emission regulations be met. Exhaust emission analysis is conducted with a constant volume sampling procedure and utilizes a flame ionization detector for hydrocarbon determination. Exhaust Emission Directive 91/441 EEC (Phase I) provides specific CO, (HC+NO) and (PM) standards, while EU Fuel Consumption Directive 93/116 EEC (1996) implements consumption standards.

The testing was performed on a 1987 VOLVO 240 DL with a B230F, 4-cylinder, 2.32 liter engine (No. LG4F20-87) developing 83 kW at 90 revolutions/second and a torque of 185 Nm at 46 revolutions/second.

Example 1

Example 1 demonstrates the possibility of reducing the dry vapor pressure equivalent of the ethanol-containing motor fuel for the cases when gasolines with dry vapor pressure equivalent according to ASTM D-5191 on a level of 90 kPa (about 13 psi) are used as a hydrocarbon base.

To prepare the mixtures of this composition winter gasolines A92, A95, and A98, presently sold on the market and purchased in Sweden from SHELL, STATOIL, Q8OK and PREEM, were used.

FIG. 1 demonstrates the behavior of the DVPE of the ethanol-containing motor fuel based on winter A95 gasoline. The ethanol-containing motor fuel based on winter A92 and A98 used in this example also demonstrate a similar behavior.

The source gasoline comprised aliphatic and alicyclic $C_4$-$C_{12}$ hydrocarbons, which are both saturated and unsaturated.

The winter A92 gasoline used had the following specification:

DVPE=89.0 kPa

Anti-knock index 0.5(RON+MON)=87.7

The comparative fuel 1-1 contained A92 winter gasoline and ethanol, and had the following properties for different ethanol contents:

A92:Ethanol=95:5% by volume

DVPE=94.4 kPa 0.5(RON+MON)=89.1

A92:Ethanol=90:10% by volume

DVPE=94.0 kPa 0.5(RON+MON)=90.2

The following different embodiments of the fuels, 1-2 through 1-4, demonstrate the possibility of adjustment of the dry vapor pressure equivalent (DVPE) of the ethanol-containing motor fuel based on winter A92 gasoline.

The comparative fuel 1-2 contained A92 winter gasoline (a), ethanol (b) and oxygen-containing additives (c), and had the following properties for the different compositions:

A92:Ethanol:Isobutyl acetate=88.5:4.5:7% by volume

DVPE=89.0 kPa 0.5(RON+MON)=89.9

A92:Ethanol:Isoamyl acetate=88:5:7% by volume

DVPE=88.6 kPa 0.5(RON+MON)=89.0

A92:Ethanol:Diacetone alcohol=88.5:4.5:7% by volume

DVPE=89.0 kPa 0.5(RON+MON)=89.65

AA92:Ethanol:Ethylacetoacetate=90.5:2.5:7% by volume

DVPE=89.0 kPa 0.5(RON+MON)=87.8

The comparative fuel of the compositions 1-2 ((a)+(b)+(c)) demonstrates the possibility of reducing the vapor pressure of the gasoline-ethanol mixtures ((a)+(b)) containing not more than 5% by volume of ethanol (b), which satisfy the oxygen content requirements. However, it is not possible to achieve the same results using the selected oxygen-containing compounds (c) for higher concentrations of ethanol in the mixture.

Moreover, it should be noted that this approach to vapor pressure reduction requires adding the oxygen-containing compounds (c) in the amounts considerably higher than the amount of the ethanol component (b). Since all selected oxygen-containing compounds are more expensive than ethanol, this approach to vapor pressure reduction of the gasoline-ethanol mixtures is economically inefficient.

The comparative fuel 1-3 contained winter grade A92 gasoline (a), ethanol (b), the hydrocarbon component $C_6$-$C_{12}$ (d), and had the following properties for the various compositions:

A92:Ethanol:5-tert-butylmethaxylol=90:5:5% by volume

DVPE=91.2 kPa 0.5(RON+MON)=89.7

A92:Ethanol:Cyclooctadiene1.5=80:10:10% by volume

DVPE=90.7 kPa 0.5(RON+MON)=87.6

A92:Ethanol:Naphta=80:10:10% by volume

Boiling temperature of naphta is 100-200° C.

DVPE=91.6 kPa 0.5(RON+MON)=87.7

The comparative fuel of the composition 1-3 ((a)+(b)+(d)) does not allow to reduce the vapor pressure of the gasoline-ethanol mixtures ((a)+(b)) to the level of the source gasoline (a). Moreover, the use of many selected hydrocarbon $C_6$-$C_{12}$ compounds (d) results in a reduced anti-knock index of the final mixture of the motor fuel comprising three components ((a)+(b)+(d)), compared to the anti-knock index of the source gasoline-ethanol mixture ((a)+(b)). Thus, reducing the vapor pressure of the gasoline-ethanol mixtures by adding to the mixtures $C_6$-$C_{12}$ hydrocarbon compounds (d) is ineffective.

The fuel 1-4 contained A92 winter gasoline (a), ethanol (b), oxygen-containing compounds (c) and $C_6$-$C_{12}$ hydrocarbons (d), and had the following properties for the different compositions:

A92:Ethanol:Isoamyl alcohol:Alkylate=79:9:2:10% by volume

The boiling temperature of the alkylate is 100-130° C.

DVPE=88.5 kPa 0.5(RON+MON)=90.25

A92:Ethanol:Isobutyl acetate:Naphtha=80:5:5:10% by volume

The boiling temperature for the naphtha is 100-200° C.

DVPE=88.7 kPa 0.5(RON+MON)=88.6

A92:Ethanol:Tert-butanol:Naphtha=81:5:5:9% by volume

The boiling temperature for the naphtha is 100-200° C.

DVPE=87.5 kPa 0.5(RON+MON)=89.6

The motor fuel compositions below demonstrate that it is not always necessary to reduce the excess DVPE of the motor fuel induced by presence of ethanol to the level of DVPE of the source gasoline. In some cases it is sufficient just to get it in compliance with the requirements of the regulations in force with respect to the corresponding gasoline. The DVPE level for the winter gasoline is 90 kPa.

A92:Ethanol:Isoamyl alcohol:Benzene:Ethylbenzene:Diethylbenzene=82.5:9.5:0.5:0.5:3:4% by volume DVPE=90 kPa 0.5(RON+MON)=91.0

A92:Ethanol:Isobutyl acetate:Toluene=82.5:9.5:0.5:7.5% by volume

DVPE=90 kPa 0.5(RON+MON)=90.8

A92:Ethanol:Isobutanol:Isoamyl alcohol:m-Xylene=82.5:9.2:0.2:0.6:7.5% by volume

DVPE=90 kPa 0.5(RON+MON)=90.9

The comparative fuel 1-5 contained A98 winter gasoline and ethanol, and had the following properties for the different compositions:

The winter A98 gasoline had the following specification:

DVPE=89.5 kPa

Anti-knock index 0.5(RON+MON)=92.35

A98:Ethanol=95:5% by volume

DVPE=95.0 kPa 0.5(RON+MON)=92.85

A98:Ethanol=90:10% by volume

DVPE=94.5 kPa 0.5(RON+MON)=93.1

The following compositions 1-6 demonstrate the possibility of adjustment of the dry vapor pressure equivalent (DVPE) of the ethanol-containing motor fuel based on winter A98 gasoline.

The fuel 1-6 contained A98 winter gasoline (a), ethanol (b), oxygen-containing compounds (c) and $C_6$-$C_{12}$ hydrocarbons (d), and had the following properties for the different compositions:

A98:Ethanol:Isoamyl alcohol:Isooctane=80:5:5:10% by volume

DVPE=82.0 kPa 0.5(RON+MON)=93.2

A98:Ethanol:Isoamyl alcohol:m-Isopropyl toluene=78.2:6.1:6.1:9.6% by volume

DVPE=81.0 kPa 0.5(RON+MON)=93.8

A98:Ethanol:Isobutanol:Naphtha=80:5:5:10% by volume

The boiling point of the naphtha is 100-200° C.

DVPE=82.5 kPa 0.5(RON+MON)=92.35

A98:Ethanol:Isobutanol:Naphtha:m-Isopropyl toluene=80:5:5:5:5% by volume

The boiling point of the naphtha is 100-200° C.

DVPE=82.0 kPa 0.5(RON+MON)=93.25

A98:Ethanol:Tert-butyl acetate:Naphtha=83:5:5:7% by volume

The boiling temperature of the naphtha is 100-200° C.

DVPE=82.1 kPa 0.5(RON+MON)=92.5

The motor fuel compositions below demonstrate that it is not always necessary to reduce the excess DVPE of the motor fuel caused by presence of ethanol to the level of DVPE of the source gasoline. In some cases it is sufficient just to get it in compliance with the requirements of the regulations in force towards corresponding gasoline. The DVPE level for the winter gasoline is 90 kPa.

A98:Ethanol:Isoamyl alcohol:Isooctane=85:5:5:5% by volume

DVPE=90.0 kPa 0.5(RON+MON)=93.3

A98:Ethanol:Isobutanol:Naphtha=85:5:5:5% by volume

The boiling temperature of the naphtha is 100-200° C.

DVPE=90.0 kPa 0.5(RON+MON)=93.0

A98:Ethanol:Isobutanol:Isopropyl xylene=85:9.5:0.5:5% by volume

DVPE=90 kPa 0.5(RON+MON)=93.1

The motor fuel compositions below demonstrate that it might be necessary to reduce the excess DVPE of the motor fuel caused by presence of ethanol below the level of DVPE of the source gasoline. Normally, this is required when DVPE of the source gasoline is higher than the limits of the regulations in force with respect to the corresponding gasoline. In this way, for example, it is possible to transform the winter grade gasoline into the summer grade gasoline. The DVPE level for the summer gasoline is 70 kPa.

A98:Ethanol:Isobutanol:Isooctane:Naphtha=60:9.5:0.5:15:15% by volume

The boiling point of the naphtha is 100-200° C.

DVPE=70 kPa 0.5(RON+MON)=92.85

A98:Ethanol:Isobutanol:Alkylate:Naphtha=60:9.5:0.5:15:15% by volume

The boiling point of the naphtha is 100-200° C.

The boiling point of the alkylate is 100-130° C.

DVPE=70 kPa 0.5(RON+MON)=92.6

A98:Ethanol:Tert-butyl acetate:Naphtha=60:9:3:28% by volume

The boiling point of the naphtha is 100-200° C.

DVPE=70 kPa 0.5(RON+MON)=91.4

The comparative fuel 1-7 contained A95 winter gasoline and ethanol. The winter A95 gasoline had the following specification:

DVPE=89.5 kPa

Anti-knock index 0.5(RON+MON)=90.1

The testing in accordance with the standard test method EU 2000 NEDC EC 98/69 as described above demonstrated the following results:

| | |
|---|---|
| CO (carbon monoxide) | 2.13 g/km; |
| HC (hydrocarbons) | 0.280 g/km; |
| $NO_x$ (nitrogen oxides) | 0.265 g/km; |
| $CO_2$ (carbon dioxide) | 227.0 g/km; |
| NMHC* | 0.276 g/km; |
| Fuel consumption, $F_c$ (1/100 km) | 9.84 |

*Non-methane hydrocarbons.

The comparative fuel 1-7 had the following properties for the different compositions:

A95:Ethanol=95%:5% by volume

DVPE=94.9 kPa 0.5(RON+MON)=91.6

A95:Ethanol=90%:10% by volume (referred to as RFM1 below)

DVPE=94.5 kPa 0.5(RON+MON)=92.4

The testing of the reference fuel mixture (RFM1) demonstrated the following results, as compared to the winter A95 gasoline:

| | |
|---|---|
| CO | −15.0%; |
| HC | −7.3%; |
| $NO_x$ | +15.5%; |
| $CO_2$ | +2.4%; |
| NMHC* | −0.5%; |
| Fuel consumption, $F_c$ (1/100 km) | 0.047 |

*Non-methane hydrocarbons.
"−" represents a reduction in emission, while
"+" represents an increase in emission.

The following fuels 1-8 and 1-9 demonstrate the possibility of adjusting the dry vapor pressure equivalent (DVPE) of the ethanol-containing motor fuel based on winter A95 gasoline.

The fuel 1-8 contained A95 winter gasoline (a), ethanol (b), the oxygen-containing compounds (c), and $C_6$-$C_{12}$ hydrocarbons (d), and had the following properties for the different compositions:

A95:Ethanol:Isoamyl alcohol:Alkylate=83.7:5:2:9.3% by volume

The boiling temperature of the alkylate is 100-130° C.

DVPE=88.0 kPa 0.5(RON+MON)=91.65

A95:Ethanol:Isoamyl alcohol:Naphtha=83.7:5:2:9.3% by volume

The boiling temperature of the naphtha is 100-200° C.

DVPE=88.5 kPa 0.5(RON+MON)=90.8

A95:Ethanol:Isobutyl acetate:Alkylate=81:5:5:9% by volume

The boiling temperature of the alkylate is 100-130° C.

DVPE=87.0 kPa 0.5(RON+MON)=92.0

A95:Ethanol:Isobutyl acetate:Naphtha=81:5:5:9% by volume

The boiling temperature of the naphtha is 100-200° C.

DVPE=87.5 kPa 0.5(RON+MON)=91.1

The motor fuel compositions below demonstrate that it is not always necessary to reduce the excess DVPE of the motor fuel caused by presence of ethanol to the level of DVPE of the source gasoline. In some cases it is sufficient just to get it in compliance with the requirements of the regulations in force towards corresponding gasoline. The DVPE level for the winter gasoline is 90 kPa.

A95:Ethanol:Isoamyl alcohol:Xylene=80:9.5:0.5:10% by volume

DVPE=90.0 kPa 0.5(RON+MON)=92.1

A95:Ethanol:Isobutanol:Isoamyl alcohol:Naphtha=80:9.2:0.2:0.6:10% by volume

The boiling temperature of the naphtha is 100-200° C.

DVPE=90.0 kPa 0.5(RON+MON)=91.0

A95:Ethanol:Isobutanol:Isoamyl alcohol:Naphtha:Alkylate=80:9.2:0.2:0.6:5:5% by volume The boiling temperature of the naphtha is 100-200° C.

The boiling point of the alkylate is 100-130° C.

DVPE=90.0 kPa 0.5(RON+MON)=91.6

The motor fuel compositions below demonstrate that it might be necessary to reduce the excess DVPE of the motor fuel caused by presence of ethanol below the level of DVPE of the source gasoline. Normally, this is required when DVPE of the source gasoline is higher than the limits of the regulations in force towards corresponding gasoline. In this way, for example, it is possible to transform the winter grade gasoline into the summer grade gasoline. The DVPE level for the summer gasoline is 70 kPa.

A95:Ethanol:Isobutanol:Isoamyl alcohol:Naphtha:Isooctane=60:9.2:0.2:0.6:15:15% by volume The boiling temperature of the naphtha is 100-200° C.

DVPE=70.0 kPa 0.5(RON+MON)=91.8

A95:Ethanol:Tert-butyl acetate:Naphtha=60:9:1:30% by volume

The boiling temperature of the naphtha is 100-200° C.

DVPE=70.0 kPa 0.5(RON+MON)=90.4

The fuel 1-9 contained 75% by volume A95 winter gasoline, 9.6% by volume ethanol, 0.4% by volume isobutyl alcohol, 4.5% by volume m-isopropyl toluene and 10.5% by volume naphtha with boiling temperature of 100-200° C. This fuel formulation demonstrates the possibility of decreasing the DVPE, increasing the octane number, decreasing the level of toxic emissions in the exhaust and decreasing the fuel consumption in comparison with the reference mixture of gasoline and ethanol (RFM 1). The motor fuel composition has the following properties:

| | |
|---|---|
| density at 15° C., according to ASTM D 4052 | 749.2 kg/m$^3$; |
| initial boiling point, according to ASTM D-86 | 29° C.; |
| vaporizable portion - 70° C. | 47.6% by volume; |
| vaporizable portion - 100° C. | 55.6% by volume; |
| vaporizable portion - 150° C. | 84.2% by volume; |
| vaporizable portion - 180° C. | 97.5% by volume; |
| final boiling point | 194.9° C.; |
| evaporation residue | 1.3% by volume; |
| loss by evaporation | 1.6% by volume; |
| oxygen content, according to ASTM D-4815 | 3.7% w/w; |
| acidity, according to ASTM D-1613 weight % HAc | 0.004; |
| pH, according to ASTM D-1287 | 6.6; |
| sulfur content, according to ASTM D-5453 | 18 mg/kg; |
| gum content, according to ASTM D-381 | 1 mg/100 ml; |
| water content, according to ASTM D-6304 | 0.03% w/w; |
| aromatics, according to SS 155120, including benzene | 30.2% by volume; |
| benzene alone, according to EN 238 | 0.7% by volume; |
| DVPE, according to ASTM D 5191 anti-knock index 0.5(RON + MON), according to ASTM D 2699-86 and ASTM D-2700-86 | 89.0 kPa; 92.6 |

The motor fuel formulation 1-9 was tested in accordance with the standard test method EU 2000 NEDC EC 98/69 and the following results, as compared to winter A95 gasoline, were obtained:

| | |
|---|---|
| CO | −21%; |
| HC | −9%; |
| $NO_x$ | +12.8%; |
| $CO_2$ | +2.38%; |
| NMHC | −6.4%; |
| Fuel consumption, $F_c$ (1/100 km) | +3.2% |

The fuel formulations 1-4, 1-6, 1-8 and 1-9 showed reduced DVPE over the tested ethanol-containing motor fuels based on summer grade gasoline. Similar results are obtained when other oxygen-containing compounds and $C_6$-$C_{12}$ hydrocarbons of this invention are substituted for the additives of the examples 1-4, 1-6, 1-8 and 1-9.

To prepare the above fuel formulations 1-4, 1-6, 1-8 and 1-9 of this motor fuel composition, initially, gasoline was mixed with ethanol and the corresponding oxygen-containing compounds and $C_6$-$C_{12}$ hydrocarbons were added to the fuel mixture. The motor fuel composition obtained was then allowed to stand before testing between 1 and 24 hours at a temperature not lower than −35° C. All the above formulations were prepared without the use of any mixing devices.

It was established that is was possible to employ an additive mixture of the oxygen-containing compound other than ethanol (c) and a $C_6$-$C_{12}$ hydrocarbon component (d) for formulating the ethanol-containing motor fuels for standard internal combustion spark ignition engines meeting standard requirements for gasolines with respect to vapor pressure and anti-knock stability. The following fuel compositions 1-10 demonstrate such a possibility.

A mixture comprising 30% of isopropanol and 70% of isooctane was mixed in different proportions with ethanol and winter grade gasolines, the dry vapor pressure equivalent (DVPE) of which does not exceed 90 kPa. The DVPE of all the resulting mixtures was not higher than that required by the regulations for winter gasoline, namely 90 kPa.

A92:Ethanol:isopropanol:isooctane=75:10:4.5:10.5% by volume

DVPE=83.3 kPa 0.5(RON+MON)=92.5

A95:Ethanol:isopropanol:isooctane=80.5:4.5:4.5:10.5% by volume

DVPE=83.8 kPa 0.5(RON+MON)=92.9

A98:Ethanol:isopropanol:isooctane=92.5:2.5:1.5:3.5% by volume

DVPE=87.7 kPa 0.5(RON+MON)=93.3

Figure 2:
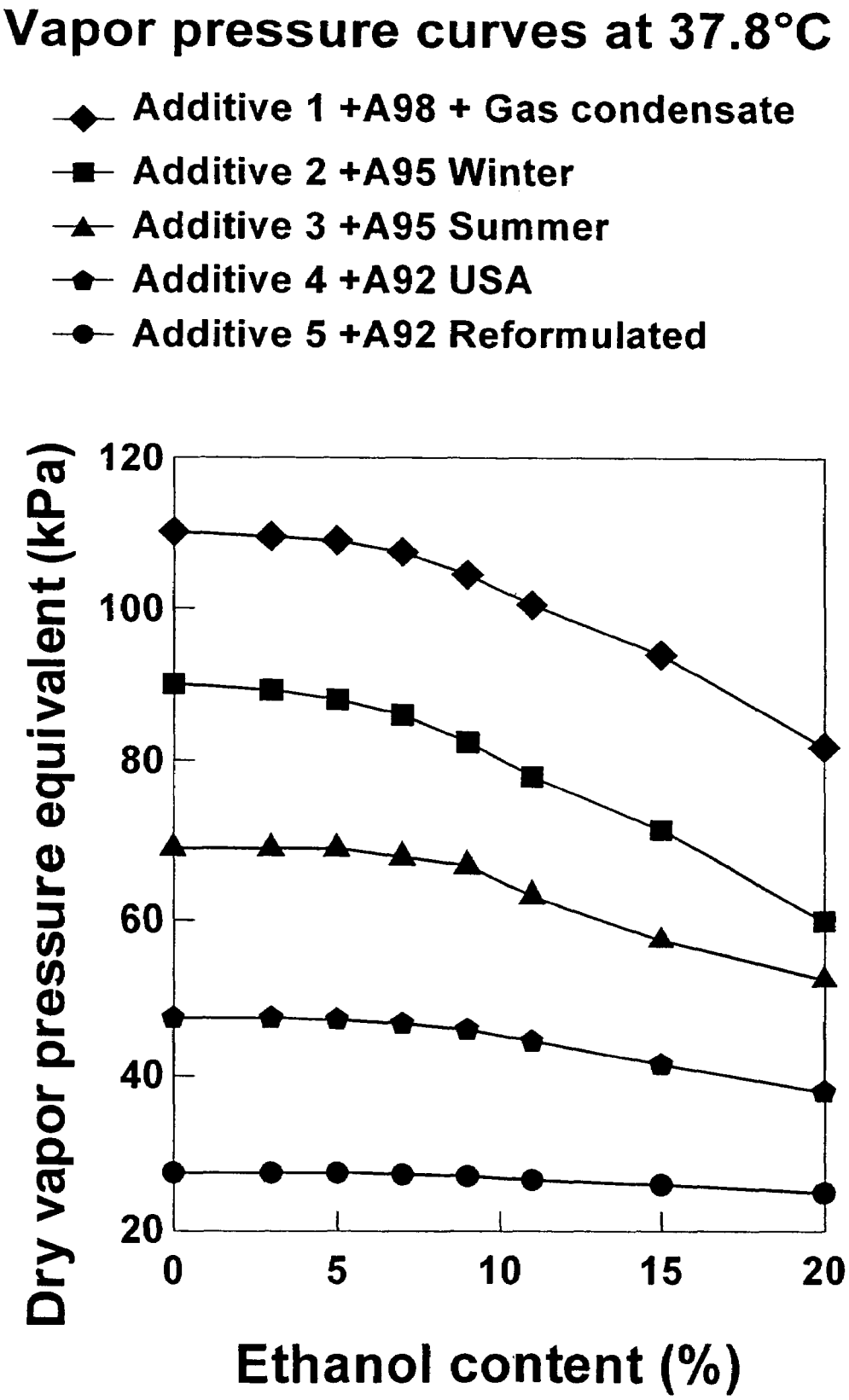
In FIG. 2, the behavior of the dry vapor pressure equivalent (DVPE) of different fuels of the present invention as a function of the ethanol content thereof is shown.

FIG. 2 shows the behavior of the dry vapor pressure equivalent (DVPE) as a function of the ethanol content when admixing the additive mixture 2 comprising 39.4% of ethanol, 0.6% of tetrahydrofurfuryl alcohol and 60% of o-xylene with A95 winter gasoline. FIG. 2 demonstrates that varying the ethanol content in gasoline within the range from 0 to 20% does not raise the vapor pressure for these compositions higher than the required standard for DVPE of the winter grade gasolines, which is 90 kPa.

Similar DVPE behavior was observed for A92 and A98 winter gasoline mixed with an additive mixture comprising 39.4% by volume of ethanol, 0.6% of tetrahydrofurfuryl alcohol and 60% of o-xylene.

The effect of the increase of the vapor pressure of the ethanol containing gasolines was not observed when the ethanol was mixed in advance with the oxygen-containing compound other than ethanol (component (c)) and with at least one $C_6$-$C_{12}$ hydrocarbon (component (d)). The inventive compositions 1-11 below demonstrate the effect achieved by the present invention.

An mixture comprising 40% by volume of ethanol, 10% by volume of isobutanol and 50% by volume of isopropyltoluene was mixed with winter gasoline with DVPE not higher than 90 kPa. The different obtained compositions had the following properties:

A92:Ethanol:Isobutanol:Isopropyltoluene=85:6:1.5:7.5% by volume

DVPE=84.9 kPa 0.5(RON+MON)=93.9

A95:Ethanol:Isobutanol:Isopropyltoluene=80:8:2:10% by volume

DVPE=84.0 kPa 0.5(RON+MON)=94.1

A98:Ethanol:Isobutanol:Isopropyltoluene=86:5.6:1.4:7% by volume

DVPE=85.5 kPa 0.5(RON+MON)=93.8

Similar results were obtained when other oxygen-containing compounds and also $C_6$-$C_{12}$ hydrocarbons of the present invention were used in the ratio of the invention to prepare the additive mixture, which was then used to prepare the ethanol-containing gasolines. These gasolines fully meet the requirements for motor fuels used in the standard spark ignition engines.

Example 2

Example 2 demonstrates the possibility of reducing the dry vapor pressure equivalent of the ethanol-containing motor fuel for the cases when gasolines with a dry vapor pressure equivalent according to ASTM D-5191 on a level of 70 kPa (about 10 psi) are used as a hydrocarbon base.

To prepare the mixtures of this composition summer gasolines A92, A95 and A98 presently sold on the market and purchased in Sweden from SHELL, STATOIL, Q80K, and PREEM, were used.

The source gasoline comprised aliphatic and alicyclic $C_4$-$C_{12}$ hydrocarbons, including saturated and unsaturated ones.

FIG. 1 shows the behavior of the DVPE of the ethanol-containing motor fuel based on summer A95 gasoline. The ethanol-containing motor fuels based on winter A92 and A98 gasolines, respectively, demonstrated similar behavior.

The following fuels 2-2 and 2-3 demonstrate the possibility of adjusting the dry vapor pressure equivalent (DVPE) of the ethanol-containing motor fuel based on summer A92 gasoline.

The summer A92 gasoline had the following properties:

DVPE=70.0 kPa

Anti-knock index 0.5(RON+MON)=87.5

The comparative fuel 2-1 contained A92 summer gasoline and ethanol, and had the following properties for the different compositions:

A92:Ethanol=95:5% by volume

DVPE=77.0 kPa 0.5(RON+MON)=89.3

A92:Ethanol=90:10% by volume

DVPE=76.5 kPa 0.5(RON+MON)=90.5

The comparative fuel 2-2 contained A92 summer gasoline (a), ethanol (b), and the oxygen-containing additives (c), and had the following properties for the different compositions:

A92:Ethanol:Isoamyl alcohol=85:6.5:6.5% by volume

DVPE=69.8 kPa 0.5(RON+MON)=90.3

A92:Ethanol:Isobutanol=80:10:10% by volume

DVPE=67.5 kPa 0.5(RON+MON)=90.8

A92:Ethanol:Diethylcarbinol=87:6.5:6.5% by volume

DVPE=69.6 kPa 0.5(RON+MON)=90.5

A92:Ethanol:Diisobutyl ketone=85.5:7.5:7% by volume

DVPE=69.0 kPa 0.5(RON+MON)=90.0

A92:Ethanol:Diisobutyl ether=85:8:7% by volume

DVPE=68.9 kPa 0.5(RON+MON)=90.1

A92:Ethanol:Di-n-butyl ester=85:8:7% by volume

DVPE=68.5 kPa 0.5(RON+MON)=88.5

A92:Ethanol:Isobutylacetate=88:5:7% by volume

DVPE=69.5 kPa 0.5(RON+MON)=89.5

The fuel of the composition 2-2 ((a)+(b)+(c)) demonstrates the possibility of reducing the vapor pressure of the gasoline-ethanol mixtures ((a)+(b)) containing not more than 10% by volume of ethanol (b) to the level of the vapor pressure of source gasoline (a), while at the same time satisfying the oxygen content requirements. Specifically, such content is 7% by weight of the total weight of the final mixture. However, it is not possible to achieve these results for the higher concentrations of ethanol in the mixture by using the selected oxygen-containing compounds (c).

Moreover, it should be noted that this approach to vapor pressure reduction requires adding the oxygen-containing compounds (c) in the amounts comparable to the amount of ethanol (b) in the mixture. As mentioned above, all selected oxygen-containing compounds are more expensive than ethanol, which makes this approach to vapor pressure reduction of the gasoline-ethanol mixtures economically inefficient on an industrial scale.

The comparative fuel of the compositions 2-3 contained summer grade A92 gasoline (a), ethanol (b) and the $C_6$-$C_{12}$ hydrocarbon component (d), and had the following properties for the various compositions:

A92:Ethanol:m-xylol=87:6.5:6.5% by volume

DVPE=72.3 kPa 0.5(RON+MON)=89.7

A92:Ethanol:isooctane=85:7:8% by volume

DVPE=72.5 kPa 0.5(RON+MON)=89.5

A92:Ethanol:alcylate=80:10:10% by volume

The boiling temperature for the alcylate 100-130° C.

DVPE=71.3 kPa 0.5(RON+MON)=90.7

The fuel of the compositions 2-3 ((a)+(b)+(d)) does not allow to reduce the vapor pressure of the gasoline-ethanol mixtures ((a)+(b)) to the level of the vapor pressure of the source gasoline (a). Component (d), which is selected from $C_6$-$C_{12}$ hydrocarbons, is rather expensive. In some cases, its price is higher than that of ethanol. This makes using component (d) in large amounts for the purpose of reducing the vapor pressure of the gasoline-ethanol mixtures economically inefficient. Moreover, using considerable amounts of component (d) changes the properties of the distillation curve of the final composition in such a manner, that it violates the limits set by the standard requirements regarding gasolines.

The fuel 2-4 contained A92 summer gasoline (a), ethanol (b), the oxygen-containing compounds (c) and $C_6$-$C_{12}$ hydrocarbons (d), and had the following properties for the different compositions:

A92:Ethanol:Diethylcarbinol:M-xylol=80.5:6.5:6.5:6.5% by volume

DVPE=63.3 kPa 0.5(RON+MON)=91.9

A92:Ethanol:Isobutanol:Alcylate=70:10:10:10% by volume

Boiling temperature of alcylate is 100-130° C.

DVPE=60.3 kPa 0.5(RON+MON)=91.8

The two compositions above demonstrate convincingly that the mutual effect of components (c) and (d) on the vapor pressure and the anti-knock index of the gasoline-ethanol fuel ((a)+(b)) is not merely a sum of the individual effects of components (c) and (d) on the properties of the final mixture. One can also compare the properties of the fuels 2-2 and 2-3 containing the same components (b), (c) or (d) even at the same concentrations.

It is evident that the mutual effect of components (c) and (d) on the properties of the gasoline-ethanol fuel, most importantly, on the saturated vapor pressure and anti-knock index, is considerably more complex than the mere sum of the individual effects, producing unexpected and surprising results.

A92:Ethanol:Isobutanol:Isononane=80:9.5:0.5:10% by volume

DVPE=68.8 kPa 0.5(RON+MON)=91.0

A92:Ethanol:Isobutanol:Isodecane=80:9.5:0.5:10% by volume

DVPE=68.5 kPa 0.5(RON+MON)=90.8

A92:Ethanol:Methyl ketone:Isooctene=80:9.5:0.5:10% by volume

DVPE=69.0 kPa 0.5(RON+MON)=91.0

A92:Ethanol:Isobutanol:Toluene=80:9.5:0.5:10% by volume

DVPE=68.5 kPa 0.5(RON+MON)=91.4

A92:Ethanol:Isobutanol:Naphtha=80:9.5:0.5:10% by volume

The boiling temperature for the naphtha is 100-200° C.

DVPE=67.5 kPa 0.5(RON+MON)=90.4

A92:Ethanol:Isobutanol:Naphtha:Toluene=80:9.5:0.5:5:5% by volume

The boiling temperature for the naphtha is 100-200° C.

DVPE=67.5 kPa 0.5(RON+MON)=90.9

A92:Ethanol:Isobutanol:Naphtha:Isopropyltoluene=80:9.5:0.5:5:5% by volume

The boiling temperature for the naphtha is 100-200° C.

DVPE=67.5 kPa 0.5(RON+MON)=91.2

The motor fuel compositions below demonstrate that it is not always necessary to reduce the excess DVPE of the motor fuel caused by presence of ethanol to the level of DVPE of the source gasoline. In some cases it is sufficient just to get it in compliance with the requirements of the regulations in force towards corresponding gasoline. The DVPE level for the summer gasoline is 70 kPa.

A92:Ethanol:Isobutanol:Isodecane=82.5:9.5:0.5:7.5% by volume

DVPE=70.0 kPa 0.5(RON+MON)=90.85

A92:Ethanol:Isobutanol:Tertbutylbenzene=82.5:9.5:0.5:7.5% by volume

DVPE=70.0 kPa 0.5(RON+MON)=91.5

A92:Ethanol:Isobutanol:Isoamyl alcohol:Naphtha:Tertbutyltoluene=82.5:9.2:0.2:0.6:5:2.5% by volume DVPE=70.0 kPa 0.5(RON+MON)=91.1

The comparative fuel 2-5 contained A98 summer gasoline and ethanol. The summer A98 gasoline had the following specification:

DVPE=69.5 kPa

Anti-knock index 0.5(RON+MON)=92.5

The comparative fuel 2-5 had the following properties for the different compositions:

A98:Ethanol=95:5% by volume

DVPE=76.5 kPa 0.5(RON+MON)=93.3

A98:Ethanol=90:10% by volume

DVPE=76.0 kPa 0.5(RON+MON)=93.7

The following fuels 2-6 demonstrate the possibility of adjusting the dry vapor pressure equivalent (DVPE) of the ethanol-containing motor fuel based on summer A98 gasoline.

The fuel 2-6 contained A98 summer gasoline (a), ethanol (b), the oxygen-containing compounds (c) and $C_6$-$C_{12}$ hydrocarbons (d), and had the following properties for the different compositions:

A98:Ethanol:Isobutanol:Isooctane=80:9.5:0.5:10% by volume

DVPE=69.0 kPa 0.5(RON+MON)=93.7

A98:Ethanol:Isopropanol:Alkylbenzene=80:5:5:10% by volume

DVPE=68.5 kPa 0.5(RON+MON)=94.0

The motor fuel compositions below demonstrate that it is not always necessary to reduce the excess DVPE of the motor fuel caused by the presence of ethanol to the level of DVPE of the source gasoline. In some cases it is sufficient just to get it in compliance with the requirements of the regulations in force towards corresponding gasoline. The DVPE level for the summer gasoline is 70 kPa.

A98:Ethanol:Isobutanol:Isooctane=81.5:9.5:0.5:8.5% by volume

DVPE=70.0 kPa 0.5(RON+MON)=93.5

A98:Ethanol:Tert-butanol:Limonene=86:7:4:4% by volume

DVPE=70.0 kPa 0.5(RON+MON)=93.6

The comparative fuel 2-7 contained A95 summer gasoline and ethanol. The summer A95 gasoline had the following specification:

DVPE=68.5 kPa

Anti-knock index 0.5(RON+MON)=89.8

The testing performed as above demonstrated for the summer A95 gasoline the following results:

| | |
|---|---|
| CO (carbon monoxide) | 2.198 g/km; |
| HC (hydrocarbons) | 0.245 g/km; |
| $NO_x$ (nitrogen oxides) | 0.252 g/km; |
| $CO_2$ (carbon dioxide) | 230.0 g/km; |
| NMHC* | 0.238 g/km; |
| Fuel consumption, $F_c$ (1/100 km) | 9.95 |

*Non-methane hydrocarbons.

The comparative fuel 2-7 had the following properties for the different compositions:

A95:Ethanol=95%:5% by volume

DVPE=75.5 kPa 0.5(RON+MON)=90.9

A95:Ethanol=90%:10% by volume (also referred to as RFM 2 below)

DVPE=75.0 kPa 0.5(RON+MON)=92.25

The testing of the reference fuel mixture (RFM 2) demonstrated the following results, as compared to summer A95 gasoline:

| | |
|---|---|
| CO | −9.1%; |
| HC | −4.5%; |
| $NO_x$ | +7.3%; |
| $CO_2$ | +4.0%; |
| NMHC* | −4.4%; |
| Fuel consumption, $F_c$ (1/100 km) | +3.6% |

"−" represents a reduction in emission, while
"+" represents an increase in emission The following fuels 2-8 demonstrate the possibility of adjusting the dry vapor pressure equivalent (DVPE) of the ethanol-containing motor fuel based on summer A95 gasoline.

The fuel 2-8 contained A95 summer gasoline (a), ethanol (b), the oxygen-containing compounds (c), and $C_6$-$C_{12}$ hydrocarbons (d), and had the following properties for the different compositions:

A95:Ethanol:Tert-pentanol:Alkylbenzene=80:7:4:9% by volume

DVPE=67.5 kPa 0.5(RON+MON)=93.6

A95:Ethanol:Tert-butanol:Alkylbenzene=80:7:4:9% by volume

DVPE=68.0 kPa 0.5(RON+MON)=93.8

A95:Ethanol:Propanol:Xylene=80:9.5:0.5:10% by volume

DVPE=68.0 kPa 0.5(RON+MON)=93.1

A95:Ethanol:Diethylketone:Xylene=80:9.5:0.5:10% by volume

DVPE=68.0 kPa 0.5(RON+MON)=93.2

A95:Ethanol:Isobutanol:Naphtha:Isopropyltoluene=80:9.5:0.5:5:5% by volume

The boiling temperature for the naphtha is 100-170° C.

DVPE=68.0 kPa 0.5(RON+MON)=92.4

A95:Ethanol:Isobutanol:Naphtha:Alkylate=80:9.5:0.5:5:5% by volume

The boiling temperature for the naphtha is 100-170° C.

The boiling temperature for the alkylate is 100-130° C.

DVPE=68.5 kPa 0.5(RON+MON)=92.2

The motor fuel compositions below demonstrate that it is not always necessary to reduce the excess DVPE of the motor fuel caused by the presence of ethanol to the level of DVPE of the source gasoline. In some cases it is sufficient just to get it in compliance with the requirements of the regulations in force towards corresponding gasoline. The DVPE level for the summer gasoline is 70 kPa.

A95:Ethanol:Isobutanol:Isoamyl alcohol:Xylene=82.5:9.2:0.2:0.6:7.5% by volume

DVPE=70.0 kPa 0.5(RON+MON)=93.0

A95:Ethanol:Isobutanol:Isoamyl alcohol:Cyclooctadiene=82.5:9.2:0.2:0.6:7.5% by volume DVPE=70.0 kPa 0.5(RON+MON)=92.1

The fuel formulation 2-9 contained 81.5% by volume of A95 summer gasoline, 8.5% by volume of m-isopropyltoluene, 9.2% by volume of ethanol, and 0.8% by volume of isoamyl alcohol. Formulation 2-9 was tested to demonstrate how the inventive composition maintained the dry vapor pressure equivalent at a same level as the source gasoline while increasing the octane number, while decreasing the level of toxic emissions in the exhaust and decreasing the fuel consumption in comparison with the mixture RFM 2 of gasoline and ethanol. Formulation 2-9 had the following specific properties:

| | |
|---|---|
| density at 15° C., according to ASTM D-4052 | 754.1 kg/m$^3$; |
| initial boiling point, according to ASTM D-86 | 26.6° C.; |
| vaporizable portion - 70° C. | 45.2% by volume; |
| vaporizable portion - 100° C. | 56.4% by volume; |
| vaporizable portion - 150° C. | 88.8% by volume; |
| vaporizable portion - 180° C. | 97.6% by volume; |
| final boiling point | 186.3° C.; |
| evaporation residue | 1.6% by volume; |
| loss by evaporation | 0.1% by volume; |
| oxygen content, according to ASTM D-4815 | 3.56% w/w; |
| acidity, according to ASTM D-1613 weight % HAc | 0.007; |
| pH, according to ASTM D-1287 | 8.9; |
| sulfur content, according to ASTM D-5453 | 16 mg/kg; |
| gum content, according to ASTM D-381 | <1 mg/100 ml; |
| water content, according to ASTM D-6304 | 0.12% w/w; |
| aromatics, according to SS 155120, including benzene | 30.3% by volume; |
| benzene alone, according to EN 238 | 0.8% by volume; |
| DVPE, according to ASTM D-5191 | 68.5 kPa; |
| anti-knock index 0.5(RON + MON), according to ASTM D-2699-86 and ASTM D-2700-86 | 92.7 |

The motor fuel formulation 2-9 was tested in accordance with test method EU 2000 NEDC EC 98/69 as above and gave the following results in comparison (+) or (−) % with the results for the source A95 summer gasoline:

| | |
|---|---|
| CO | −0.18% |
| HC | −8.5%; |
| $NO_x$ | +5.3%; |
| $CO_2$ | +2.8%; |
| NMHC | −9%; |
| Fuel consumption, $F_c$ (1/100 km) | +3.1% |

The fuel formulations 2-4, 2-6, 2-8 and 2-9 showed a reduced DVPE over the tested ethanol-containing motor fuels based on summer grade gasoline. Similar results are obtained when other oxygen-containing compounds and $C_6$ to $C_{12}$ hydrocarbons of the invention are substituted for components (c) and (d) in formulations 2-4, 2-6, 2-8 and 2-9.

To prepare all the above fuel formulations 2-4, 2-6, 2-8 and 2-9, gasoline was initially mixed with ethanol. Subsequently, the corresponding oxygen-containing compounds and $C_6$ to $C_{12}$ hydrocarbons were added to the mixture. The motor fuel composition obtained was then allowed to stand before testing between 1 and 24 hours at a temperature not lower than −35° C. All of the above formulations were prepared without the use of any mixing devices.

The use of an additive mixture comprising ethanol (component (b)), $C_6$ to $C_{12}$ hydrocarbons (component (d)) and oxygen-containing compounds other than ethanol (component (c)) for preparation of the ethanol-containing gasolines was accomplished with summer grade gasolines. The fuel compositions below demonstrate the possibility to obtain the ethanol-containing gasolines meeting standard requirements towards summer grade gasolines, including vapor pressure of not higher than 70 kPa.

FIG. 2 shows the behavior of the dry vapor pressure equivalent (DVPE) as a function of the ethanol content while mixing summer A95 gasoline with the additive mixture 3 comprising 35% by volume of ethanol, 5% by volume of isoamyl alcohol, and 60% by volume of naphtha boiling at temperatures between 100-170° C. FIG. 2 demonstrates that varying of the ethanol content in gasoline within the range from 0 to 20% does not induce an increase of the vapor pressure for these compositions higher than the requirement of the standard for DVPE of the summer grade gasolines, which is 70 kPa.

Similar DVPE behavior was observed for A92 and A98 summer gasoline mixed with an additive mixture comprising 35% by volume of ethanol, 5% by volume of isoamyl alcohol, and 60% by volume of naphtha boiling at 100-170° C.

The ratio between the amount of ethanol (b) and the sum of the amounts of $C_6$ to $C_{12}$ hydrocarbons and the oxygen-containing compounds other than ethanol ((c)+(d)) in the additive mixture (b)/{(c)+(d)}, which is used for preparation of the ethanol-containing gasolines, is of substantial importance. The ratio between the components of the additive established by the present invention, specifically 1:200 to 200:1, enables the adjusting of the vapor pressure of the ethanol-containing gasolines over a wide range of formulations.

The compositions 2-10 below demonstrate the possibility to employ the additive mixtures with both high and low ethanol content. An additive mixture comprising 92% by volume of ethanol, 6% by volume of isooctane, and 2% by volume of isobutanol was mixed with summer grade gasoline. The obtained compositions had the following properties:

A92:Ethanol:Isooctane:Isobutanol=80:18.4:1.2:0.4% by volume

DVPE=69.5 kPa 0.5(RON+MON)=90.8

A95:Ethanol:Isooctane:Isobutanol=82:16.56:1.08:0.36% by volume

DVPE=69.9 kPa 0.5(RON+MON)=93.0

A98:Ethanol:Isooctane:Isobutanol=78:20.24:1.32:0.44% by volume

DVPE=69.1 kPa 0.5(RON+MON)=94.8

An additive mixture comprising 25% by volume of ethanol, 60% by volume of isooctane, and 15% by volume of isobutanol was mixed with summer grade gasoline. The obtained compositions had the following properties:

A92:Ethanol:Isooctane:Isobutanol=80:5:12:3% by volume

DVPE=66.5 kPa 0.5(RON+MON)=89.2

A95:Ethanol:Isooctane:Isobutanol=84:4:9.6:2.4% by volume

DVPE=66.0 kPa 0.5(RON+MON)=91.8

A98:Ethanol:Isooctane:Isobutanol=86:3.5:8.4:2.1% by volume

DVPE=65.6 kPa 0.5(RON+MON)=93.4

Similar results were obtained when other oxygen-containing compounds (c) and also $C_6$-$C_{12}$ hydrocarbons (d) of this invention were used in the ratio established by this invention to prepare the additive mixture, which was then used for preparation of the ethanol-containing gasolines. These gasolines entirely meet the requirements for the motor fuels used in the standard spark ignition engines.

Moreover, the additive mixture comprising ethanol, the oxygen-containing compound of this invention other than ethanol and $C_6$-$C_{12}$ hydrocarbons with the ratio of the present invention can be used as an independent motor fuel for the engines adapted for operation on ethanol.

Example 3

Example 3 demonstrates the possibility of reducing the dry vapor pressure equivalent of the ethanol-containing motor fuel for the cases when gasolines with dry vapor pressure equivalent according to ASTM D-5191 on a level of 48 kPa (about 7 psi) are used as a hydrocarbon base.

To prepare the mixtures of this composition lead-free summer gasolines A92, A95, and A98 meeting U.S. standards and purchased in the USA under the trademarks PHILLIPS J BASE FUEL, UNION CLEAR BASE and INDOLENE, were used.

The source gasolines comprised aliphatic and alicyclic $C_5$-$C_{12}$ hydrocarbons, including both saturated and unsaturated ones.

FIG. 1 shows the behavior of the DVPE of the ethanol-containing motor fuel based on U.S. summer grade A92 gasoline. The ethanol-containing motor fuels based on U.S. summer A95 and A98 gasolines, respectively, demonstrated similar behavior.

The U.S. summer A92 gasoline had the following specification:

DVPE=47.8 kPa

Anti-knock index 0.5(RON+MON)=87.7

The comparative fuel 3-1 contained U.S. A92 summer gasoline and ethanol, and had the following properties for the different compositions:

A92:Ethanol=95:5% by volume

DVPE=55.9 kPa 0.5(RON+MON)=89.0

A92:Ethanol=90:10% by volume

DVPE=55.4 kPa 0.5(RON+MON)=90.1

The comparative fuel 3-2 contained U.S. A92 summer gasoline, ethanol and the oxygen-containing additives, and had the following properties for the different compositions:

A92:Ethanol:Isoamyl propionate=82:8:10% by volume

DVPE=47.0 kPa 0.5(RON+MON)=89.9

A92:Ethanol:2-Ethylhexanol=82:8:10% by volume

DVPE=47.8 kPa 0.5(RON+MON)=89.2

A92:Ethanol:Tetrahydrofurfuryl alcohol=82:7:10% by volume

DVPE=47.8 kPa 0.5(RON+MON)=89.3

A92:Ethanol:Cyclohexanone=82:7:10% by volume

DVPE=47.7 kPa 0.5(RON+MON)=89.1

The fuel of the compositions 3-2 ((a)+(b)+(c)) demonstrate the possibility of reducing the vapor pressure of the gasoline-ethanol mixtures ((a)+(b)) containing not more than 10% by volume of ethanol (b) to the level of the vapor pressure of the source gasoline (a). However, it is not possible to achieve the same results for the higher concentrations of ethanol in the mixture. At the same time, the high price of the oxygen-containing compounds (c), which are used for reducing the vapor pressure of gasoline-ethanol mixtures ((a)+(b)), as well as the need for their considerable amounts, make this approach inefficient on an industrial scale.

The comparative fuel of the compositions 3-3 contained winter grade A92 gasoline (a), ethanol (b) and the hydrocarbon component $C_6$-$C_{12}$ (d), and had the following properties for the various compositions:

A92:Ethanol:Limonene=80:10:10% by volume

DVPE=48.3 kPa 0.5(RON+MON)=87.2

A92:Ethanol:Isooctane=80:10:10% by volume

DVPE=51.4 kPa 0.5(RON+MON)=90.8

A92:Ethanol:Paraxylol=80:10:10% by volume

DVPE=50.9 kPa 0.5(RON+MON)=90.7

The fuel of the compositions 3-3 ((a)+(b)+(d)) do not allow to reduce the vapor pressure of the gasoline-ethanol mixtures ((a)+(b)) to the level of the vapor pressure of the source gasoline (a). Furthermore, taking into account the high price of the $C_6$-$C_{12}$ hydrocarbon component (d) and a need for its considerable amount for the fuel composition, it is evident that this approach to vapor pressure reduction of the gasoline-ethanol fuel is not economically sound.

The fuel 3-4 contained U.S. A92 summer gasoline (a), ethanol (b), the oxygen-containing additives (c), and $C_6$-$C_{12}$ hydrocarbons (d), and had the following properties for the different compositions:

A92:Ethanol:Isoamyl alcohol:Isobutyl alcohol:Naphtha=75:9.2:0.3:0.1:15.4% by volume The boiling temperature for the naphtha is 100-200° C.

DVPE=47.8 kPa 0.5(RON+MON)=89.5

A92:Ethanol:Isoamyl alcohol:Isobutyl alcohol:m-Isopropyltoluene=75:9.2:0.3:0.1:15.4% by volume DVPE=47.0 kPa 0.5(RON+MON)=90.5

A92:Ethanol:Isoamyl alcohol:Isobutyl alcohol:Isooctane=75:9.2:0.3:0.1:15.4% by volume DVPE=47.8 kPa 0.5(RON+MON)=90.3

The motor fuel compositions below demonstrate that it is not always necessary to reduce the excess DVPE of the motor fuel caused by the presence of ethanol to the level of DVPE of the source gasoline. In some cases it is sufficient just to get it in compliance with the requirements of the regulations in force towards corresponding gasoline. The DVPE level for the U.S. summer grade gasoline is 7 psi, which corresponds to 48.28 kPa.

A92:Ethanol:Isoamyl alcohol:Isobutyl alcohol:Naphtha=76:9.2:0.3:0.1:14.4% by volume The boiling temperature for the naphtha is 100-200° C.

DVPE=48.2 kPa 0.5(RON+MON)=89.6

A92:Ethanol:Isoamyl alcohol:Isobutyl alcohol:Naphtha:Isooctane=76:9.2:0.3:0.1:10.4:4% by volume The boiling temperature for the naphtha is 100-200° C.

DVPE=48.2 kPa 0.5(RON+MON)=89.8

A92:Ethanol:Isoamyl alcohol:Isobutyl alcohol:Naphtha:m-Isopropyl toluene=77:9.2:0.3:0.1:10.4:3% by volume The boiling temperature for the naphtha is 100-200° C.

DVPE=48.2 kPa 0.5(RON+MON)=89.9

The following fuels demonstrate the possibility of adjusting the dry vapor pressure equivalent (DVPE) of the ethanol-containing motor fuel based on U.S. A98 summer gasoline.

The U.S. A98 gasoline had the following specification:

DVPE=48.2 kPa

Anti-knock index 0.5(RON+MON)=92.2

The comparative fuel 3-5 contained U.S. A98 summer gasoline and ethanol, and had the following properties for the different compositions:

A98:Ethanol=95:5% by volume

DVPE=56.3 kPa 0.5(RON+MON)=93.0

A98:Ethanol=90:10% by volume

DVPE=55.8 kPa 0.5(RON+MON)=93.6

The fuel 3-6 contained U.S. A98 summer gasoline (a), ethanol (b), the oxygen-containing compounds (c) and $C_6$-$C_{12}$ hydrocarbons (d), and had the following properties for the different compositions:

A98:Ethanol:Isoamyl alcohol:Isobutyl alcohol:Naphtha=75:9.2:0.3:0.1:15.4% by volume The boiling temperature for the naphtha is 100-200° C.

DVPE=48.2 kPa 0.5(RON+MON)=93.3

A98:Ethanol:Isoamyl alcohol:Isobutyl alcohol:Isooctane=75:9.2:0.3:0.1:15.4% by volume DVPE=48.2 kPa 0.5(RON+MON)=93.9

A98:Ethanol:Isoamyl alcohol:Isobutyl alcohol:m-Isopropyltoluene=75.5:9.2:0.3:0.1:14.9% by volume DVPE=47.5 kPa 0.5(RON+MON)=94.4

A98:Ethanol:Isoamyl alcohol:Isobutyl alcohol:Naphtha:Isooctane=75:9.2:0.3:0.1:8.4:7% by volume The boiling temperature for the naphtha is 100-200° C.

DVPE=48.2 kPa 0.5(RON+MON)=93.6

A98:Ethanol:Isoamyl alcohol:Isobutyl alcohol:Naphtha:m-Isopropyl toluene=75:9.2:0.3:0.1:10.4:5% by volume The boiling temperature for the naphtha is 100-200° C.

DVPE=48.0 kPa 0.5(RON+MON)=93.7

A98:Ethanol:Isoamyl alcohol:Isobutyl alcohol:Naphtha:Alkylate=75:9.2:0.3:0.1:7.9:7.5% by volume The boiling temperature for the naphtha is 100-200° C.

The boiling temperature for the alkylate is 100-130° C.

DVPE=48.2 kPa 0.5(RON+MON)=93.6

The following fuels demonstrated the possibility of adjusting the dry vapor pressure equivalent (DVPE) of the ethanol-containing motor fuel based on U.S. summer A95 gasoline.

The U.S. summer A95 gasoline had the following specification:

DVPE=47.0 kPa

Anti-knock index 0.5(RON+MON)=90.9

The U.S. summer A95 gasoline was used as a reference fuel for the testing performed according to EU2000 NEDC EC 98/69 test cycle on a 1987 VOLVO 240 DL with a B230F, 4-cylinder, 2.32 liter engine (No. LG4F20-87) developing 83 kW at 90 revolutions/second and a torque of 185 Nm at 46 revolutions/second.

The testing performed as above demonstrated for the U.S. summer A95 gasoline the following results:

| | |
|---|---|
| CO (carbon monoxide) | 2.406 g/km; |
| HC (hydrocarbons) | 0.356 g/km; |
| $NO_x$ (nitrogen oxides) | 0.278 g/km; |
| $CO_2$ (carbon dioxide) | 232.6 g/km; |
| NMHC* | 0.258 g/km; |
| Fuel consumption, $F_c$ (1/100 km) | 9.93 |

*Non-methane hydrocarbons.

The comparative fuel 3-7 contained U.S. A95 summer gasoline and ethanol, and had the following properties for the different compositions:

A95:Ethanol=95:5% by volume

DVPE=55.3 kPa 0.5(RON+MON)=91.5

A95:Ethanol=90:10% by volume

DVPE=54.8 kPa 0.5(RON+MON)=92.0

The testing of the reference gasoline-alcohol mixture (RFM 3) comprising 90% by volume of U.S. A95 summer grade gasoline and 10% by volume of ethanol performed on a 1987 VOLVO 240 DL with a B230F, 4-cylinder, 2.32 liter engine (No. LG4F20-87) in accordance with the standard test method EU 2000 NEDC EC 98/69 demonstrated the following results, as compared to summer U.S. A95 gasoline:

| | |
|---|---|
| CO | −12.5%; |
| HC | −4.8%; |
| $NO_x$ | +2.3%; |
| $CO_2$ | +3.7%; |
| NMHC* | −4.0%; |
| Fuel consumption, $F_c$ (1/100 km) | +3.1% |

"−" represents a reduction in emission, while
"+" represents an increase in emission.

The fuel 3-8 contained U.S. A95 summer gasoline (a), ethanol (b), the oxygen-containing compounds (c) and $C_6$-$C_{12}$ hydrocarbons (d), and had the following properties for the different compositions:

A95:Ethanol:Isoamyl alcohol:Isobutyl alcohol:Naphtha=75:9.2:0.3:0.1:15.4% by volume The boiling temperature for the naphtha is 100-200° C.

DVPE=47.0 kPa 0.5(RON+MON)=91.6

A95:Ethanol:Isoamyl alcohol:Isobutyl alcohol:Isooctane=75:9.2:0.3:0.1:15.4% by volume DVPE=47.0 kPa 0.5(RON+MON)=92.2

A95:Ethanol:Isoamyl alcohol:Isobutyl alcohol:m-Isopropyltoluene=75:9.2:0.3:0.1:15.4% by volume DVPE=46.8 kPa 0.5(RON+MON)=93.0

A95:Ethanol:Tetrahydrofurfuryl alcohol:Cyclooctatetraene=80:9.5:0.5:10% by volume DVPE=46.6 kPa 0.5(RON+MON)=92.5

A95:Ethanol:4-Methyl-4-oxytetrahydropyran:Allocymene=80:9.5:0.5:10% by volume

DVPE=46.7 kPa 0.5(RON+MON)=92.1

The motor fuel compositions below demonstrate that it is not always necessary to reduce the excess DVPE of the motor fuel caused by the presence of ethanol to the level of DVPE of the source gasoline. In some cases it is sufficient just to get it in compliance with the requirements of the regulations in force towards corresponding gasoline. The DVPE level for the U.S. summer grade gasoline is 7 psi, which corresponds to 48.28 kPa.

A95:Ethanol:Isoamyl alcohol:Isobutyl alcohol:Naphtha=76.5:9.2:0.3:0.1:13.9% by volume The boiling temperature for the naphtha is 100-200° C.

DVPE=48.2 kPa 0.5(RON+MON)=91.7

A95:Ethanol:Isoarnyl alcohol:Isobutyl alcohol:Naphtha: Isooctane=76.5:9.2:0.3:0.1:7.0:6.9% by volume The boiling temperature for the naphtha is 100-200° C.

DVPE=48.2 kPa 0.5(RON+MON)=92.2

A95:Ethanol:Isoamyl alcohol:Isobutyl alcohol:m-Isopropyltoluene=77:9.2:0.3:0.1:13.4% by volume DVPE=48.2 kPa 0.5(RON+MON)=92.9

The fuel formulation 3-9 contained 76% by volume of U.S. A95 summer gasoline, 9.2% by volume of ethanol, 0.25% by volume of isoamyl alcohol, 0.05% by volume of isobutyl alcohol, 11.5% by volume of naphtha with boiling temperature of 100-200° C., and 3% by volume of isopropyltoluene. Formulation 3-9 was tested to demonstrate how the invention enables the production of ethanol-containing gasoline entirely meeting the requirements of the standards in force, firstly towards level of the DVPE and also towards other parameters. At the same time this gasoline secures decrease of toxic emissions in the exhaust and lower fuel consumption in comparison to the mixture RFM 3 of source U.S. A95 summer gasoline with 10% of ethanol. Formulation 3-9 had the following specific properties:

| | |
|---|---|
| density at 15° C., according to ASTM D-4052 | 774.9 kg/m$^3$; |
| initial boiling point, according to ASTM D-86 | 36.1° C.; |
| vaporizable portion - 70° C. | 33.6% by volume; |
| vaporizable portion - 100° C. | 50.8% by volume; |
| vaporizable portion - 150° C. | 86.1% by volume; |
| vaporizable portion - 190° C. | 97.0% by volume; |
| final boiling point | 204.8° C.; |
| evaporation residue | 1.5% by volume; |
| loss by evaporation | 1.5% by volume; |
| oxygen content, according to ASTM D-4815 | 3.37% w/w; |
| acidity, according to ASTM D-1613 weight % HAc | 0.007; |
| pH, according to ASTM D-1287 | 7.58; |
| sulfur content, according to ASTM D-5453 | 47 mg/kg; |
| gum content, according to ASTM D-381 | 2.8 mg/100 ml; |
| water content, according to ASTM D-6304 | 0.02% w/w; |
| aromatics, according to SS 155120, including benzene | 31.2% by volume; |
| benzene alone, according to EN 238 | 0.7% by volume; |
| DVPE, according to ASTM D-5191 | 48.0 kPa; |
| anti-knock index 0.5(RON + MON), according to ASTM D-2699-86 and ASTM D-2700-86 | 92.2 |

The motor fuel formulation 3-9 was tested on a 1987 VOLVO 240 DL with a B230F, 4-cylinder, 2.32 liter engine (No. LG4F20-87) in accordance with test method EU 2000 NEDC EC 98/69 as above and gave the following results in comparison (+) or (−) % with the results for the source U.S. A95 summer gasoline:

| | |
|---|---|
| CO | −15.1% |
| HC | −5.6%; |
| $NO_x$ | +0.5%; |

-continued

| | |
|---|---|
| $CO_2$ | unchanged; |
| NMHC | −4.5%; |
| Fuel consumption, $F_c$ (1/100 km) | unchanged. |

Similar results were obtained when other oxygen-containing compounds and $C_6$ to $C_{12}$ hydrocarbons were substituted for such compounds identified above.

To prepare fuel formulations 3-4, 3-6, 3-8 and 3-9, initially, U.S. summer gasoline was mixed with ethanol, to which mixture were then added the corresponding oxygen-containing compounds and $C_6$ to $C_{12}$ hydrocarbons. The motor fuel composition obtained was then allowed to stand before testing between 1 and 24 hours at a temperature not lower than −35° C. All the above formulations were prepared without the use of any mixing devices.

It was established that there is a possibility of employing the additive mixture comprising ethanol (component (b)), $C_6$ to $C_{12}$ hydrocarbons (component (d)) and oxygen-containing compounds other than ethanol ((component (c)) to adjust the vapor pressure of the ethanol-containing motor fuels used in standard internal combustion spark ignition engines based on summer grade gasolines meeting U.S. regulatory standards. Using $C_8$-$C_{12}$ hydrocarbons in the composition of the additive mixture increased the efficiency of the vapor pressure reducing impact of the additive on the excess vapor pressure caused by presence in the gasoline of ethanol.

FIG. 2 shows the behavior of the dry vapor pressure equivalent (DVPE) as a function of the ethanol content in the mixtures of U.S. summer A92 gasoline and the additive mixture 4 comprising 35% by volume of ethanol, 1% by volume of isoamyl alcohol, 0.2% by volume of isobutanol, 43.8% by volume of naphtha boiling at temperatures between 100-170° C., and 20% of isopropyl toluene.

FIG. 2 demonstrates that employment of this additive mixture in formulation of ethanol-containing gasoline enables the reduction that is greater than 100% of the excess vapor pressure induced by presence of ethanol.

Similar results for DVPE were obtained for U.S. summer grade A95 and A98 gasoline mixed with the additive mixture composed of 35% by volume of ethanol, 1% by volume of isoamyl alcohol, 0.2% by volume of isobutanol, 43.8% by volume of naphtha boiling at 100-170° C. and 20% by volume of isopropyltoluene.

Similar results were obtained when other oxygen-containing compounds and $C_6$-$C_{12}$ hydrocarbons of this invention were used in the proportion established by this invention to formulate the additive mixture, which was then used for preparation of the ethanol-containing gasolines. These gasolines entirely meet the requirements towards the motor fuels used in standard internal combustion spark ignition engines.

Moreover, the additive mixture comprising ethanol, the oxygen-containing compound other than ethanol, and $C_6$-$C_{12}$ hydrocarbons in the proportion and composition of the present invention, can be used as an independent motor fuel for the engines adopted for operation on ethanol.

Example 4

Example 4 demonstrates the possibility of reducing the dry vapor pressure equivalent of the ethanol-containing motor fuel for the cases when the hydrocarbon base of the fuel is a non-standard gasoline with a dry vapor pressure equivalent according to ASTM D-5191 on a level of 110 kPa (about 16 psi).

To prepare the mixtures of this composition lead-free winter gasoline A92, A95, and A98 purchased in Sweden from SHELL, STATOIL, Q80K and PREEM and gas condensate (GC) purchased in Russia from GAZPROM were used.

The hydrocarbon component (HCC) for the motor fuel compositions was prepared by mixing about 85% by volume of winter A92, A95 or A98 gasoline with about 15% by volume of gas condensate hydrocarbon liquid (GC).

To prepare the hydrocarbon component (HCC) for the fuel formulations 4-1 to 4-10 of this motor fuel composition, about 85% by volume of winter A92, A95 or A98 gasoline was first mixed with the gas condensate hydrocarbon liquid (GC). The obtained hydrocarbon component (HCC) was then allowed to stand for 24 hours. The resulting gasoline contained aliphatic and alicyclic $C_3$-$C_{12}$ hydrocarbons, including saturated and unsaturated ones.

FIG. 1 demonstrates the behavior of the DVPE of the ethanol-containing motor fuel based on winter A98 gasoline and gas condensate. The ethanol-containing motor fuel based on winter A92 and A98 gasoline and gas condensate (GC) demonstrated similar behavior.

Gasoline comprising 85% by volume of winter gasoline A92 and 15% by volume of gas condensate (GC) had the following properties:

DVPE=110.0 kPa

Anti-knock index 0.5(RON+MON)=87.9

The comparative fuel 4-1 contained A92 winter gasoline, gas condensate (GC) and ethanol, and had the following properties for the different compositions:

A92:GC:Ethanol=80.75:14.25:5% by volume

DVPE=115.5 kPa 0.5(RON+MON)=89.4

A92:GC:Ethanol=76.5:13.5:10% by volume

DVPE=115.0 kPa 0.5(RON+MON)=90.6

The comparative fuel 4-2 contained A92 winter gasoline, gas condensate (GC), ethanol and the oxygen-containing additive, and had the following properties for the different compositions:

A92:GC:Ethanol:Isoamyl alcohol=74:13:6.5:6.5% by volume

DVPE=109.8 kPa 0.5(RON+MON)=90.35

A92:GC:Ethanol:2,5 Dimethyltetrahydrofuran=68:12:10:10% by volume

DVPE=110.0 kPa 0.5(RON+MON)=90.75

A92:GC:Ethanol:Acetophenone=72:13:9:6% by volume

DVPE=110.0 kPa 0.5(RON+MON)=90.8

The fuel of the compositions 4-2 ((a)+(b)+(c)) demonstrates the possibility of reducing the vapor pressure of the gasoline-ethanol mixtures ((a)+(b)) without violating the regulatory limits set for the oxygen content. However, this is only possible if the ethanol content does not exceed 5% by volume. Further, as discussed above, the oxygen-containing compounds employed for reducing the vapor pressure of gasoline-ethanol mixtures are considerably more expensive than ethanol. Therefore, employing compositions 4-2 ((a)+(b)+(c)) to reduce vapor pressure of the gasoline-ethanol fuels is of no practical interest.

The comparative fuel 4-3 contained winter grade A92 gasoline and gas condensate (GC), which were both a component (a), ethanol (b) and $C_6$-$C_{12}$ hydrocarbon component (d), and had the following properties for the various compositions:

A92:GC:Ethanol:n-cymol=68:12:10:10% by volume

DVPE=112.2 kPa 0.5(RON+MON)=91.6

A92:GC:Ethanol:Alcylate=72:13:7.5:7.5% by volume

The boiling temperature for the alcylate is 100-130° C.

DVPE=112.5 kPa 0.5(RON+MON)=90.45

A92:CG:Ethanol:Naphtha=76:14:5:5% by volume

The boiling temperature for the naphtha is 100-200° C.

DVPE=112.4 kPa 0.5(RON+MON)=88.45

The fuel of the compositions 4-3 ((a)+(b)+(d)) does not allow to reduce the vapor pressure of the gasoline-ethanol mixtures ((a)+(b)) to the level of the source gasoline (a) when the concentration of component (d) is similar to the that of ethanol. At the same time, using higher concentrations of component (d) results in a considerable increase in the fuel price, which makes this approach economically inefficient.

The fuel 4-4 contained winter A92 gasoline, gas condensate (GC), ethanol, the oxygen-containing additive and $C_6$-$C_{12}$ hydrocarbons, and had the following properties for the different compositions:

A92:GC:Ethanol:Isobutanol:Isopropylbenzene=68:12:9.5:0.5:10% by volume

DVPE=108.5 kPa 0.5(RON+MON)=91.7

A92:GC:Ethanol:Tert-butyl ethyl ether:Naphtha=68:12:9.5:0.5:10% by volume

The boiling temperature for the naphtha is 100-200° C.

DVPE=108.5 kPa 0.5(RON+MON)=90.6

A92:GC:Ethanol:Isoamyl methyl ether:Toluene=68:12:9.5:0.5:10% by volume

DVPE=107.5 kPa 0.5(RON+MON)=91.6

The fuel compositions below demonstrate that the invention enables the reduction of the excess DVPE of the non-standard gasoline to the level of the corresponding standard gasoline. The DVPE for the standard A92 winter gasoline is 90 kPa.

A92:GC:Ethanol:Isoamyl alcohol:Naphtha:Alkylate=55:10:9.5:0.5:12.5:12.5% by volume The boiling temperature for the naphtha is 100-200° C.

The boiling temperature for the alkylate is 100-130° C.

DVPE=90.0 kPa 0.5(RON+MON)=90.6

A92:GC:Ethanol:Isoamyl alcohol:Naphtha:Ethylbenzene=55:10:9.5:0.5:15:10% by volume The boiling temperature for the naphtha is 100-200° C.

DVPE=89.8 kPa 0.5(RON+MON)=90.9

A92:GC:Ethanol:Isoamyl alcohol:Naphtha:Isopropyltoluene=55:10:9.5:0.5:20:5% by volume The boiling temperature for the naphtha is 100-200° C.

DVPE=90.0 kPa 0.5(RON+MON)=90.6

The following compositions demonstrate the possibility of adjustment of the dry vapor pressure equivalent (DVPE) of the ethanol-containing fuel mixtures based on about 85% by volume of winter A98 gasoline and about 15% by volume of gas condensate.

The gasoline comprising 85% by volume of winter A98 gasoline and 15% by volume of gas condensate (GC) had the following specification:

DVPE=109.8 kPa

Anti-knock index 0.5(RON+MON)=92.0

The comparative fuel 4-5 contained A98 winter gasoline, gas condensate (GC) and ethanol, and had the following properties for the different compositions:

A98:GC:Ethanol=80.75:14.25:5% by volume

DVPE=115.3 kPa 0.5(RON+MON)=93.1

A98:GC:Ethanol=76.5:13.5:10% by volume

DVPE=114.8 kPa 0.5(RON+MON)=94.0

The fuel 4-6 contained A98 winter gasoline, gas condensate, ethanol, the oxygen-containing additives, and $C_6$-$C_{12}$ hydrocarbons (d), and had the following properties for the different compositions:

A98:GC:Ethanol:Isoamyl alcohol:Isobutyl alcohol:Naphtha=68:12:9.2:0.6:0.2:10% by volume The boiling temperature for the naphtha is 100-200° C.

DVPE=107.4 kPa 0.5(RON+MON)=93.8

A98:GC:Ethanol:Ethylisobutyl ether:Myrcene=72:13:9.5:0.5:5% by volume

DVPE=110.0 kPa 0.5(RON+MON)=93.6

A98:GC:Ethanol:Isobutanol:Isooctane=68:12:5:5:10% by volume

DVPE=102.5 kPa 0.5(RON+MON)=93.5

The motor fuel compositions below demonstrate that the invention enables the reduction of the excess DVPE of non-standard gasoline to the level of DVPE of the corresponding standard gasoline. The DVPE for the standard winter A98 gasoline is 90.0 kPa.

A92:GC:Ethanol:Isoamyl alcohol:Naphtha:Alkylate=55:10:9.5:0.5:12.5:12.5% by volume The boiling temperature for the naphtha is 100-200° C.

The boiling temperature for the alkylate is 100-130° C.

DVPE=89.8 kPa 0.5(RON+MON)=94.0

A92:GC:Ethanol:Isoamyl alcohol:Naphtha:Isopropylbenzene=55:10:9.5:0.5:15:10% by volume The boiling temperature for the naphtha is 100-200° C.

DVPE=89.6 kPa 0.5(RON+MON)=94.2

A92:GC:Ethanol:Isobutanol:Naphtha:Isopropyltoluene=55:10:5:5:20:5% by volume

The boiling temperature for the naphtha is 100-200° C.

DVPE=88.5 kPa 0.5(RON+MON)=94.1

The following compositions demonstrate the possibility of adjustment of the dry vapor pressure equivalent (DVPE) of the ethanol-containing fuel mixtures based on about 85% by volume of winter A95 gasoline and about 15% by volume of gas condensate.

The gasoline comprising 85% by volume of winter A95 gasoline and 15% by volume of gas condensate (GC) had the following specification:

DVPE=109.5 kPa

Anti-knock index 0.5(RON+MON)=90.2

The hydrocarbon component (HCC) comprising 85% by volume of winter gasoline and 15% by volume of gas condensate (GC) was used as a reference fuel for testing as described above and gave the following results:

| | |
|---|---|
| CO | 2.033 g/km; |
| HC | 0.279 g/km; |
| $NO_x$ | 0.279 g/km; |
| $CO_2$ | 229.5 g/km; |
| NMHC | 0.255 g/km; |
| Fuel consumption, $F_c$ (1/100 km) | 9.89 |

The comparative fuel 4-7 contained A95 winter gasoline, gas condensate (GC) and ethanol, and had the following properties for the different compositions:

A95:GC:Ethanol=80.75:14.25:5% by volume

DVPE=115.0 kPa 0.5(RON+MON)=91.7

A95:GC:Ethanol=76.5:13.5:10% by volume

DVPE=114.5 kPa 0.5(RON+MON)=92.5

The reference fuel mixture (RFM 4) comprising 80.75% of winter A95 gasoline, 14.25% of gas condensate (GC) and 5% of ethanol was tested as described above and gave the following results in comparison (+) or (−) % with the results for the gasoline comprising 85% by volume of winter gasoline A95 and 15% by volume of gas condensate (GC):

| | |
|---|---|
| CO | −6.98% |
| HC | −7.3%; |
| $NO_x$ | +12.1%; |
| $CO_2$ | +1.1%; |
| NMHC | −5.3%; |
| Fuel consumption, $F_c$ (1/100 km) | +2.62% |

The fuel 4-8 contained A95 winter gasoline, gas condensate (GC), ethanol, the oxygen-containing compounds and $C_6$-$C_{12}$ hydrocarbons (d), and had the following properties for the different compositions:

A95:GC:Ethanol:Isoamyl alcohol:Isobutyl alcohol:Naphtha=68:12:9.2:0.6:0.2:10% by volume The boiling temperature for the naphtha is 100-200° C.

DVPE=107.0 kPa 0.5(RON+MON)=92.1

A95:GC:Ethanol:Isobutanol:Cyclooctatetraene=72:13:9.5:0.5:5% by volume

DVPE=108.5 kPa 0.5(RON+MON)=92.6

The motor fuel compositions below demonstrate that the invention enables the reduction of the excess vapor pressure equivalent (DVPE) of the non-standard gasoline to the level of the corresponding standard gasoline. The DVPE of the standard winter gasoline A95 is 90.0 kPa.

A95:GC:Ethanol:Isoamyl alcohol:Isobutanol:Naphtha:Alkylate=55:10:9.2:0.6:0.2:12.5:12.5% by volume The boiling temperature for the naphtha is 100-200° C.

The boiling temperature for the alkylate is 100-130° C.

DVPE=89.5 kPa 0.5(RON+MON)=92.4

A95:GC:Ethanol:Isoamyl alcohol:Naphtha:Tert-butylxylene=55:10:9.5:0.5:20:5% by volume The boiling temperature for the naphtha is 100-200° C.

DVPE=89.8 kPa 0.5(RON+MON)=92.5

A95:GC:Ethanol:Isobutanol:Naphtha:Isopropylbenzene=55:10:5:5:20:5% by volume

The boiling temperature for the naphtha is 100-200° C.

DVPE=89.9 kPa 0.5(RON+MON)=92.2

The motor fuel 4-9 contained 55% by volume of A95 winter gasoline, 10% by volume of gas condensate (GC), 5% by volume of ethanol, 5% by volume of tert-butanol, 20% by volume of naphtha with boiling temperature of 100-200° C. and 5% by volume of isopropyltoluene. Formulation 4-9 was tested to demonstrate how the invention enables the formulation of the ethanol-containing gasoline entirely meeting requirements of the standards in force, firstly in respect of dry vapor pressure equivalent limit, and also for the other parameters of the fuel, even when the source hydrocarbon component (HCC) has a DVPE considerably higher than the requirements of the standards. At the same time this ethanol-containing gasoline decreases the level of toxic emissions in the exhaust and decreases the fuel consumption in comparison with the above-described mixture RFM 4. Formulation 4-9 had the following specific properties:

| | |
|---|---|
| density at 15° C., according to ASTM D-4052 | 698.6 kg/m$^3$; |
| initial boiling point, according to ASTM D-86 | 20.5° C.; |
| vaporizable portion - 70° C. | 47.0% by volume; |
| vaporizable portion - 100° C. | 65.2% by volume; |
| vaporizable portion - 150° C. | 92.4% by volume; |
| vaporizable portion - 180° C. | 97.3% by volume; |
| final boiling point | 189.9° C.; |
| evaporation residue | 0.5% by volume; |
| loss by evaporation | 1.1% by volume; |
| oxygen content, according to ASTM D-4815 | 3.2% w/w; |
| acidity, according to ASTM D-1613 weight % HAc | 0.001; |
| pH, according to ASTM D-1287 | 7.0; |
| sulfur content, according to ASTM D-5453 | 18 mg/kg; |
| gum content, according to ASTM D-381 | 2 mg/100 ml; |
| water content, according to ASTM D-6304 | 0.01% w/w; |
| aromatics, according to SS 155120, including benzene | 30.9% by volume; |
| benzene alone, according to EN 238 | 0.7% by volume; |
| DVPE, according to ASTM D 5191 | 90.0 kPa; |
| anti-knock index 0.5(RON + MON), according to ASTM D 2699-86 and ASTM D 2700-86 | 92.3 |

The motor fuel formulation 4-9 was tested as above and gave the following results in comparison (+) or (−) % with the results for the motor fuel comprising 85% by volume of winter A95 gasoline and 15% by volume of gas condensate:

| | |
|---|---|
| CO | −14.0% |
| HC | −8.6%; |
| $NO_x$ | unchanged; |
| $CO_2$ | +1.0%; |
| NMHC | −6.7%; |
| Fuel consumption, $F_c$ (1/100 km) | +2.0% |

Similar results are obtained when other oxygen-containing compounds and $C_6$ to $C_{12}$ hydrocarbons are substituted for the oxygen-containing additives and $C_6$ to $C_{12}$ hydrocarbons in formulations 4-4, 4-6, 4-8 and 4-9.

To prepare all of the above fuel formulations 4-4,4-6, 4-8 and 4-9 of this motor fuel composition, the hydrocarbon component (HCC), which is a mixture of winter gasoline and gas condensate (GC), was initially mixed with ethanol, to which mixture then was added the corresponding oxygen-containing additive and $C_6$-$C_{12}$ hydrocarbons. The motor fuel composition obtained was then allowed to stand before testing between 1 and 24 hours at a temperature not lower than −35° C. All the above formulations were prepared without the use of any mixing devices.

The inventive fuel formulations demonstrated the possibility to adjust the vapor pressure of the ethanol-containing motor fuels for the standard internal combustion spark ignition engines based on non-standard gasolines having a high vapor pressure.

FIG. 2 shows the behavior of the dry vapor pressure equivalent (DVPE) as a function of the ethanol content of the mixtures of the hydrocarbon component (HCC), comprising 85% by volume of winter A98 gasoline and 15% by volume of gas condensate, and the additive mixture 1, comprising 40% by volume of ethanol, 0.5% by volume of 3,3,5-trimethylcyclohexanone, and 59.5% by volume of 5-tert-butylmethaxylol.

FIG. 2 demonstrates that employment of this additive mixture comprising ethanol, oxygen-containing compounds other than ethanol and $C_6$-$C_{12}$ hydrocarbons enables the attainment of ethanol-containing gasolines, the vapor pressure of which does not exceed the vapor pressure of the source hydrocarbon component (HCC) over the range of ethanol concentrations from 0.1% to 20% of the total volume of the gasoline-ethanol fuel.

Similar results for DVPE were obtained for the fuel mixtures of the additive mixture comprising 40% by volume of ethanol 0.5% by volume of 3,3,5-trimethylcyclohexanone and 59.5% by volume of 5-tert-butylmethaxylol, and hydrocarbon component comprising 15% by volume of gas condensate (GC) and 85% by volume of A92 or A95 winter gasoline.

Similar results were obtained when other oxygen-containing compounds and $C_6$-$C_{12}$ hydrocarbons of this invention were used in the proportion of the invention to formulate the additive mixture, which was then used for preparation of the ethanol-containing gasolines.

These gasoline mixtures of the invention have a vapor pressure equivalent (DVPE) which does not exceed the DVPE of the source hydrocarbon component (HCC). At the same time it is possible to add the oxygen-containing additive only in the amount sufficient to obtain the ethanol-containing gasoline entirely in compliance with requirements towards the motor fuels used in the standard internal combustion spark ignition engines.

Example 5

Example 5 demonstrates the possibility of reducing the dry vapor pressure equivalent of the ethanol-containing motor fuel for the cases when the hydrocarbon base of the fuel is a reformulated gasoline with dry vapor pressure equivalent according to ASTM D-5191 on a level of 27.5 kPa (about 4 psi).

To prepare the mixtures of this composition lead-free reformulated gasoline purchased in Sweden from PREEM and in Russia from LUKOIL, and the Petroleum benzine purchased from MERK in Germany were used.

The hydrocarbon component (HCC) for the motor fuel compositions was prepared by mixing about 85% by volume of winter A92, A95 or A98 gasoline with about 15% by volume of Petroleum benzine.

The source gasolines comprised aliphatic and alicyclic $C_6$-$C_{12}$ hydrocarbons, including saturated and unsaturated.

FIG. 1 demonstrates the behavior of the DVPE of the ethanol-containing motor fuel based on reformulated gasoline A92 and Petroleum benzine. Similar behavior was observed for the ethanol-containing motor fuel based on reformulated A95 and A98 gasoline, and Petroleum benzine.

It should be pointed out that addition of ethanol to the reformulated gasoline induces a higher vapor pressure increase compared to the addition of ethanol to the standard gasoline.

Gasoline comprising 80% by volume of reformulated gasoline A92 and 20% by volume of Petroleum benzine (PB) had the following properties:

DVPE=27.5 kPa

Anti-knock index 0.5(RON+MON)=85.5

The comparative fuel 5-1 contained A92 reformulated gasoline, Petroleum benzine (PB) and ethanol, and had the following properties for the different compositions:

A92:PB:Ethanol=76:19:5% by volume

DVPE=36.5 kPa 0.5(RON+MON)=89.0

A92:PB:Ethanol=72:18:10% by volume

DVPE=36.0 kPa 0.5(RON+MON)=90.7

The comparative fuel 5-2 contained A92 reformulated gasoline, Petroleum benzine (PB), ethanol and the oxygen-containing additive, and had the following properties for the different compositions:

A92:PB:Ethanol:Isoamyl alcohol=64:16:10:10% by volume

DVPE=27.0 kPa 0.5(RON+MON)=90.5

A92:PB:Ethanol:Diisobutyl ether=64:16:10:10% by volume

DVPE=27.5 kPa 0.5(RON+MON)=90.8

A92:PB:Ethanol:n-Butanol=64:16:10:10% by volume

DVPE=27.5 kPa 0.5(RON+MON)=90.1

The fuel 5-2 ((a)+(b)+(c)) demonstrates the possibility of reducing the vapor pressure of the gasoline-ethanol mixtures ((a)+(b)) containing up to 10% by volume of ethanol without violating the regulatory limits set for the oxygen content. However, it is not possible to accomplish the same results for the higher concentrations of ethanol in the mixture using selected oxygen-containing compounds (c).

Furthermore, the amount of the oxygen-containing component required for reducing the vapor pressure of the gasoline-ethanol fuel is comparable to the amount of ethanol. Since all of the selected oxygen-containing compounds are considerably more expensive than ethanol, this approach to vapor pressure reduction of the gasoline-ethanol fuels is of no practical interest.

The comparative fuel 5-3 contained reformulated A92 gasoline and Petroleum benzine (PB), which were component (a), ethanol (b) and $C_8$-$C_{12}$ hydrocarbon component (d), and had the following properties for the various compositions:

A92:PB:Ethanol:Allocymene=60:15:10:15% by volume

DVPE=29.0 kPa 0.5(RON+MON)=88.5

A92:PB:Ethanol:Limonene=60:15:10:15% by volume

DVPE=28.0 kPa 0.5(RON+MON)=85.1

A92:PB:Ethanol:M-cymene=60:15:10:15% by volume

DVPE=28.5 kPa 0.5(RON+MON)=92.2

The fuel 5-3 ((a)+(b)+(d)) does not result in a reduction in vapor pressure of the gasoline-ethanol mixtures ((a)+(b)) to the level of the vapor pressure of the source gasoline (a) when the concentration of component (d) is up to 15% of the volume of the final mixture. At the same time, employing higher concentrations of the hydrocarbon component (d) is unacceptable, because such a fuel would be difficult to use in a standard gasoline engine.

The fuel 5-4 contained reformulated A92 gasoline, Petroleum benzine (PB), ethanol, the oxygen-containing additives and also $C_8$-$C_{12}$ hydrocarbons, and had the following properties for the different compositions:

A92:PB:Ethanol:Isoamyl alcohol>Naphtha=60:15:9.2:0.8:15% by volume

The boiling temperature for the naphtha is 140-200° C.

DVPE=27.5 kPa 0.5(RON+MON)=89.3

A92:PB:Ethanol:n-Butanol:Naphtha:Xylene=60:15:9.2:0.8:7.5:7.5% by volume

The boiling temperature for the naphtha is 140-200° C.

DVPE=27.5 kPa 0.5(RON+MON)=91.2

A92:PB:Ethanol:Tetrahydrofurfuryl alcohol:Isopropylbenzene=60:15:9:1:15% by volume DVPE=27.5 kPa 0.5(RON+MON)=91.3

The fuel compositions below demonstrate the possibility to adjust the dry vapor pressure equivalent of the ethanol-containing gasolines based on reformulated A98 gasoline and Petroleum benzine (PB).

The motor fuel comprising 80% by volume of reformulated gasoline A98 and 20% by volume of Petroleum benzine (PB) had the following properties:

DVPE=27.3 kPa

Anti-knock index 0.5(RON+MON)=88.0

The comparative fuel 5-5 contained A98 reformulated gasoline, Petroleum benzine (PB) and ethanol, and had the following propel ties for the different compositions:

A98:PB:Ethanol=76:19:5% by volume

DVPE=36.3 kPa 0.5(RON+MON)=91.0

A98:PB:Ethanol=72:18:10% by volume

DVPE=35.8 kPa 0.5(RON+MON)=92.5

The fuel 5-6 contained A98 reformulated gasoline, Petroleum benzine (PB), ethanol, the oxygen-containing additives, and $C_8$-$C_{12}$ hydrocarbons (d), and had the following properties for the different compositions:

A98:PB:Ethanol:Isoamyl alcohol:Naphtha=60:15:9.2:0.8:15% by volume

The boiling temperature for the naphtha is 140-200° C.

DVPE=27.0 kPa 0.5(RON+MON)=91.7

A98:PB:Ethanol:Linalool:Allocymene=60:15:9:1:15% by volume

DVPE=26.0 kPa 0.5(RON+MON)=93.0

A98:PB:Ethanol:Methylcyclohexanol:Limonene=60:15:9.5:1:14.5% by volume

DVPE=25.4 kPa 0.5(RON+MON)=93.2

The motor fuel compositions below demonstrate the possibility of adjusting the dry vapor pressure equivalent of the ethanol-containing fuel mixture based on about 80% by volume of reformulated A95 gasoline and about 20% by volume of the Petroleum benzine (PB). Gasoline comprising 80% by volume of the reformulated A95 gasoline and 20% by volume of the Petroleum benzine (PB) had the following properties:

DVPE=27.6 kPa

Anti-knock index 0.5(RON+MON)=86.3

The hydrocarbon component (HCC) comprising 80% by volume of reformulated gasoline and 20% by volume of Petroleum benzine (PB) was used as a reference fuel for testing on a 1987 VOLVO 240 DL with a B230F, 4-cylinder, 2.32 liter engine (No. LG4F20-87) in accordance with test method EU 2000 NEDC EC 98/69 and gave the following results:

| | |
|---|---|
| CO | 2.631 g/km; |
| HC | 0.348 g/km; |
| $NO_x$ | 0.313 g/km; |
| $CO_2$ | 235.1 g/km; |
| NMHC | 0.308 g/km; |
| Fuel consumption, $F_c$ (1/100 km) | 10.68 |

The comparative fuel 5-7 contained A95 reformulated gasoline, Petroleum benzine (PB) and ethanol, and had the following properties for the different compositions:

A95:PB:Ethanol=76:19:5% by volume

DVPE=36.6 kPa 0.5(RON+MON)=90.2

A95:PB:Ethanol=72:18:10% by volume

DVPE=36.1 kPa 0.5(RON+MON)=91.7

The reference fuel mixture (RFM 5) comprising 72% by volume of reformulated A95 gasoline, 18% by volume of Petroleum benzine (PB) and 10% by volume of ethanol was tested on a 1987 VOLVO 240 DL with a B230F, 4-cylinder, 2.32 liter engine (No. LG4F20-87) in accordance with test method EU 2000 NEDC EC 98/69 as above and gave the following results in comparison (+) or (−) % with the results for the gasoline comprising 80% by volume of reformulated gasoline A95 and 20% by volume of Petroleum benzine (GC):

| | |
|---|---|
| CO | −4.8% |
| HC | −1.3%; |
| $NO_x$ | +26.3%; |
| $CO_2$ | +4.4%; |
| NMHC | −0.6%; |
| Fuel consumption, $F_c$ (1/100 km) | +5.7% |

The fuel 5-8 contained A95 reformulated gasoline, Petroleum benzine (PB), ethanol, the oxygen-containing compounds and $C_8$-$C_{12}$ hydrocarbons, and had the following properties for the different compositions:

A95:PB:Ethanol:Isoamyl alcohol:Naphtha=60:15:9.2:0.8:15% by volume

The boiling temperature for the naphtha is 140-200° C.

DVPE=27.1 kPa 0.5(RON+MON)=91.4

A95:PB:Ethanol:Tetrahydrofurfuryl alcohol:Tert-butylcyclohexane=60:15:9.2:0.8:15% by volume DVPE=26.5 kPa 0.5(RON+MON)=90.7

A95:PB:Ethanol:4-Methyl-4-hydroxytetrahydropyran:Isopropyltoluene=60:15:9.2:0.8:15% by volume DVPE=26.1 kPa 0.5(RON+MON)=92.0

The motor fuel 5-9 contained 60% by volume of A95 reformulated gasoline, 15% by volume of Petroleum benzine (PB), 10% by volume of ethanol, 5% by volume of 2,5-Dimethyltetrahydrofuran and 10% by volume of isopropyltoluene. Formulation 5-9 was tested to demonstrate how the invention enables the formulation of the ethanol-containing gasoline with a low vapor pressure, wherein the presence in the motor fuel composition of ethanol does not induce increase of dry vapor pressure equivalent in comparison to the source hydrocarbon component (HCC). Moreover, this gasoline secures decrease of toxic emissions in the exhaust and decrease of the fuel consumption in comparison with the above mixture RFM 5. Formulation 5-9 had the following specific properties:

| | |
|---|---|
| density at 15° C., according to ASTM D-4052 | 764.6 kg/m$^3$; |
| initial boiling point, according to ASTM D 86 | 48.9° C.; |
| vaporizable portion - 70° C. | 25.3% by volume; |
| vaporizable portion - 100° C. | 50.8% by volume; |
| vaporizable portion - 150° C. | 76.5% by volume; |
| vaporizable portion - 190° C. | 95.6% by volume; |
| final boiling point | 204.5° C.; |
| evaporation residue | 1.4% by volume; |
| loss by evaporation | 0.5% by volume; |
| oxygen content, according to ASTM D-4815 | 4.6% w/w; |
| acidity, according to ASTM D-1613 weight % HAc | 0.08; |
| pH, according to ASTM D-1287 | 7.5; |
| sulfur content, according to ASTM D-5453 | 39 mg/kg; |
| gum content, according to ASTM D-381 | 1.5 mg/100 ml; |
| water content, according to ASTM D-6304 | 0.1% w/w; |
| aromatics, according to SS 155120, including benzene | 38% by volume; |
| benzene alone, according to EN 238 | 0.4% by volume; |
| DVPE, according to ASTM D-5191 | 27.2 kPa; |
| anti-knock index 0.5(RON + MON), according to ASTM D-2699-86 and ASTM D-2700-86 | 91.8 |

The motor fuel formulation 5-9 was tested as described previously and gave the following results in comparison (+) or (−) % with the results for the motor fuel comprising 80% by volume of reformulated A95 gasoline and 20% by volume of Petroleum benzine:

| | |
|---|---|
| CO | −12.3% |
| HC | −6.2%; |
| $NO_x$ | unchanged; |
| $CO_2$ | +2.6%; |
| NMHC | −6.4%; |
| Fuel consumption, $F_c$ (l/100 km) | +3.7% |

Similar results are obtained when other oxygen-containing compounds and $C_8$ to $C_{12}$ hydrocarbons are substituted for the oxygen-containing compounds and $C_8$ to $C_{12}$ hydrocarbons in formulations 5-4, 5-6, 5-8 and 5-9.

To prepare the above fuel formulations 5-4, 5-6, 5-8 and 5-9, initially, the hydrocarbon component (HCC), which is a mixture of reformulated gasoline and Petroleum benzine (PB), was mixed with ethanol, to which mixture then was added the corresponding oxygen-containing additive and $C_8$-$C_{12}$ hydrocarbons. The motor fuel composition obtained was then allowed to stand before testing between 1 and 24 hours at a temperature not lower than −35° C. All the above formulations were prepared without the use of any mixing devices.

The invention demonstrated the possibility to adjust the vapor pressure of the ethanol-containing motor fuels for the standard internal combustion spark ignition engines based on non-standard gasolines having a low vapor pressure.

FIG. 2 shows the behavior of the dry vapor pressure equivalent (DVPE) when mixing the hydrocarbon component (HCC), comprising 80% by volume of reformulated A92 gasoline and 20% by volume of Petroleum benzine, with the mixture 5, comprising 40% by volume of ethanol, 20% by volume of 3,3,5-trimethylcyclohexanone, and 20% by volume of naphtha with boiling temperature 130-170° C. and 20% by volume of Tert-butyltoluene.

The graph demonstrates that the use of the additive of this invention enables the attainment of the ethanol-containing gasolines, the vapor pressure of which does not exceed the vapor pressure of the source hydrocarbon component (HCC).

Similar DVPE behavior was demonstrated when mixing the above additive 5 with hydrocarbon component (HCC) comprising 20% by volume of Petroleum benzine (PB) and 80% by volume of A95 or A98 reformulated gasoline.

Similar results were obtained when other oxygen-containing compounds and $C_8$-$C_{12}$ hydrocarbons of this invention were used in the proportion of the invention to formulate the oxygen-containing additive, which was then used for preparation of the ethanol-containing gasolines.

These gasolines have a vapor pressure equivalent (DVPE) not higher than the DVPE of the source hydrocarbon component (HCC). At the same time the anti-knock index for all ethanol-containing gasolines prepared in accordance with this invention was higher than that of the source hydrocarbon component (HCC).

The foregoing description and examples of preferred embodiments of this invention should be taken as illustrating, rather than as limiting, the present invention as defined by the claims. As will be readily appreciated, numerous variations and combinations of the features set forth above can be used without departing from the present invention as set forth in the claims. All such modifications are intended to be included within the scope of the following claims.

What is claimed is:

1. A method of making a fuel composition for a modified internal combustion spark ignition engine comprising combining:

(b) a fuel grade ethanol comprising 0.5% to 99% of a total volume of the fuel composition;

(c) an oxygen-containing component comprising at least one of (1) an alkanol having from 3 to 10 carbon atoms; (2) a ketone having from 4 to 9 carbon atoms; (3) a dialkyl ether having from 6 to 10 carbon atoms; (4) an alkyl ester of an alkanoic acid, said alkyl ester having 5 to 8 carbon atoms; (5) a hydroxyketone having 4 to 6 carbon atoms; (6) a keto ester of an alkanoic acid, said keto ester having 5 to 8 carbon atoms or (7) an oxygen-containing heterocyclic compound having 5 to 8 carbon atoms selected from the group consisting of tetrahydrofurfuryl alcohol, tetrahydrofurfuryl acetate, dimethyltetrahydrofuran, tetramethyltetrahydrofuran, methyl tetrahydropyran, 4-methyl-4-oxytetrahydropyran, and mixtures thereof, and said oxygen-containing additive comprises 0.5% to 99% of the total volume of the fuel composition; and (d) at least one $C_6$-$C_{12}$ unsaturated aliphatic hydrocarbon, $C_6$-$C_{12}$ alicyclic saturated hydrocarbon, $C_6$-$C_{12}$ alicyclic unsaturated hydrocarbon, or a fraction of hydrocarbons boiling at 100-200° C., said fraction of hydrocarbons obtained in distillation of oil, bituminous coal resin or products yielded from processing of synthesis-gas, so that a ratio between components (b)/{(c)+(d)} is from 1:200 up to 200:1 by volume, wherein the fuel composition is a modified internal combustion spark ignition engine fuel.

2. The method according to claim 1, wherein said components (c) and (d) are added to said component (b).

3. A motor fuel composition for a modified internal combustion spark ignition engine comprising a mixture of:

(b) a fuel grade ethanol comprising from 25% to 99% of a total volume of the motor fuel composition;

(c) an oxygen-containing component comprising at least one of (1) an alkanol having from 3 to 10 carbon atoms; (2) a ketone having from 4 to 9 carbon atoms; (3) a dialkyl ether having from 6 to 10 carbon atoms; (4) an alkyl ester of an alkanoic acid, said alkyl ester having 5 to 8 carbon atoms; (5) a hydroxyketone having 4 to 6 carbon atoms; (6) a keto ester of an alkanoic acid, said keto ester having 5 to 8 carbon atoms or (7) an oxygen-containing heterocyclic compound having 5 to 8 carbon atoms selected from the group consisting of tetrahydrofurfuryl alcohol, tetrahydrofurfuryl acetate, dimethyltetrahydrofuran, tetramethyltetrahydrofuran, methyl tetrahydropyran, 4-methyl-4-oxytetrahydropyran, and mixtures thereof, and said oxygen-containing additive comprises 0.5% to 75% of the total volume of the motor fuel composition; and (d) at least one $C_6$-$C_{12}$ unsaturated aliphatic hydrocarbon, $C_6$-$C_{12}$ alicyclic saturated hydrocarbon, $C_6$-$C_{12}$ alicyclic unsaturated hydrocarbon, or a fraction of hydrocarbons boiling at 100-200° C., said fraction of hydrocarbons obtained in distillation of oil, bituminous coal resin or products yielded from processing of synthesis-gas, wherein a ratio between components (b)/{(c)+(d)} from 1:200 up to 200:1 by volume.

4. The composition according to claim 3, wherein said component (d) is at least one $C_8$-$C_{11}$ hydrocarbon.

5. The composition according to claim 3, comprising 5% to 70% by volume of said component (c).

6. The composition according to claim 3, wherein at least about 99.5% by volume of the component (b) is ethanol.

7. An additive, which can be combined with gasoline to provide reduced vapor pressure hydrocarbon-based motor fuel composition for a conventional internal combustion spark ignition engine, the additive comprising a mixture of:

(b) a fuel grade ethanol comprising from 25% to 99% of a total volume of the additive;

(c) an oxygen-containing component comprising at least one of (1) an alkanol having from 3 to 10 carbon atoms; (2) a ketone having from 4 to 9 carbon atoms; (3) a dialkyl ether having from 6 to 10 carbon atoms; (4) an alkyl ester of an alkanoic acid, said alkyl ester having 5 to 8 carbon atoms; (5) a hydroxyketone having 4 to 6 carbon atoms; (6) a keto ester of an alkanoic acid, said keto ester having 5 to 8 carbon atoms or (7) an oxygen-containing heterocyclic compound having 5 to 8 carbon atoms selected from the group consisting of tetrahydrofurfuryl alcohol, tetrahydrofurfuryl acetate, dimethyltetrahydrofuran, tetramethyltetrahydrofuran, methyl tetrahydropyran, 4-methyl-4-oxytetrahydropyran, and mixtures thereof, and said oxygen-containing additive comprises 0.5% to 75% of the total volume of the additive; and (d) at least one $C_6$-$C_{12}$ unsaturated aliphatic hydrocarbon, $C_6$-$C_{12}$ alicyclic saturated hydrocarbon, $C_6$-$C_{12}$ alicyclic unsaturated hydrocarbon, or a fraction of hydrocarbons boiling at 100-200° C., said fraction of hydrocarbons obtained in distillation of oil, bituminous coal resin or products yielded from processing of synthesis-gas wherein a ratio between components (b)/{(c)+(d)} from 1:200 up to 200:1 by volume.

* * * * *

UNITED STATES PATENT AND TRADEMARK OFFICE

CERTIFICATE OF CORRECTION

PATENT NO. : 7,323,020 B2
APPLICATION NO. : 10/734215
DATED : January 29, 2008
INVENTOR(S) : Angelica Hull et al.

It is certified that error appears in the above-identified patent and that said Letters Patent is hereby corrected as shown below:

COLUMN 1

Line 25, “compounds” should read --compound--.

COLUMN 4

Line 47, “hydrocarbon,” should read --hydrocarbon.--.

COLUMN 7

Line 12, “invention:alcohols,” should read --invention: alcohols,--.
Line 32, “mula” should read --mula:--; and
Line 60, “formula” should read --formula:--.

COLUMN 12

Line 22, “preferable” should read --preferably--.

COLUMN 14

Line 32, “A92:Ethanol:Naphta=80:10:10%” should read
--A92:Ethanol:Naphtha-80:10:10%--; and
Line 33, “naphta” should read --naphtha--.

COLUMN 19

Line 57, “An” should read --A--.
Line 11, “that is was” should read --that it was--.

COLUMN 27

Line 60, “strate” should read --strates--.

COLUMN 28

Line 17, “do” should read --does--.

COLUMN 31

Line 12, “Isoarnyl” should read --Isoamyl--.

UNITED STATES PATENT AND TRADEMARK OFFICE

CERTIFICATE OF CORRECTION

PATENT NO. : 7,323,020 B2
APPLICATION NO. : 10/734215
DATED : January 29, 2008
INVENTOR(S) : Angelica Hull et al.

It is certified that error appears in the above-identified patent and that said Letters Patent is hereby corrected as shown below:

COLUMN 34

Line 12, “to the” should read --to--.

COLUMN 39

Line 66, “alcohol>” should read --alcohol:--.

COLUMN 40

Line 25, “propel ties” should read --properties--.

COLUMN 44

Line 26, “(b)/{(c)+(d)} from” should read --(b)/{(c)+(d)} is from--;
Line 62, “gas” should read --gas,--; and
Line 63, “(b)/{(c)+(d)} from” should read --(b)/{(c)+(d)} is from--.

Signed and Sealed this

Twenty-sixth Day of August, 2008

JON W. DUDAS
*Director of the United States Patent and Trademark Office*